US010682735B2

(12) United States Patent
Richardson

(10) Patent No.: US 10,682,735 B2
(45) Date of Patent: Jun. 16, 2020

(54) METHOD AND APPARATUS FOR APPLYING A UNIFORM TEXTURE TO A SUBSTANTIALLY VERTICAL SURFACE

(71) Applicant: Vertical Concrete Polishing Inc., Whitesburg, GA (US)

(72) Inventor: Mark Jack Richardson, Whitesburg, GA (US)

(73) Assignee: Vertical Concrete Polishing Inc., Whitesburg, GA (US)

( * ) Notice: Subject to any disclaimer, the term of this patent is extended or adjusted under 35 U.S.C. 154(b) by 176 days.

(21) Appl. No.: 15/364,193

(22) Filed: Nov. 29, 2016

(65) Prior Publication Data

US 2017/0072526 A1 Mar. 16, 2017

Related U.S. Application Data

(63) Continuation-in-part of application No. 15/362,269, filed on Nov. 28, 2016, now Pat. No. 10,414,011, (Continued)

(51) Int. Cl.
*B24B 23/00* (2006.01)
*B24B 7/18* (2006.01)
(Continued)

(52) U.S. Cl.
CPC ..... *B24B 7/182* (2013.01); *B24B 7/222* (2013.01); *B24B 23/02* (2013.01); *B24B 41/02* (2013.01)

(58) Field of Classification Search
CPC .... B28D 1/30; B28D 1/00; B28D 1/16; B24B 23/00
(Continued)

(56) References Cited

U.S. PATENT DOCUMENTS 2,075,369 A * 3/1937 Lowell ..... B24B 7/222 15/49.1
2,787,096 A * 4/1957 Riddels ..... B24B 7/222 451/354
(Continued)

FOREIGN PATENT DOCUMENTS

| | | |
|---|---|---|
| CN | 202062306 | 12/2011 |
| CN | 202097652 | 1/2012 |
| CN | 202293365 | 7/2012 |

OTHER PUBLICATIONS

International Search Report and Written Opinion in Application No. PCT/US2015/023795 dated Jul. 6, 2015, 11 pages.
(Continued)

*Primary Examiner* — Robert A Rose
(74) *Attorney, Agent, or Firm* — Thomas|Horstemeyer, LLP

(57) ABSTRACT

A surfacing apparatus supported adjacent a substantially vertical surface of a structure for applying an even and uniform texture to the surface of the structure using a selectively adjustable force exerted on a texturing means to engage the surface of the structure. The surfacing apparatus is suited for horizontal and vertical movement in controlled prescribed paths under controlled and prescribed pressure from the adjustable tensioning means. The surfacing apparatus can include a texturing head that can be configured to conform to the contour of a curved work surface to apply an even and uniform texture thereon.

18 Claims, 32 Drawing Sheets

Related U.S. Application Data which is a continuation of application No. 14/605,708, filed on Jan. 26, 2015, now Pat. No. 9,505,099.

(60) Provisional application No. 61/995,586, filed on Apr. 15, 2014.

(51) Int. Cl.

| | |
|---|---|
| ***B24B 7/22*** | (2006.01) |
| ***B24B 23/02*** | (2006.01) |
| ***B24B 41/02*** | (2006.01) |

(58) Field of Classification Search

USPC ..... 451/41, 354, 359; 125/25, 36, 38

See application file for complete search history.

(56) References Cited

U.S. PATENT DOCUMENTS

| | | | |
|---|---|---|---|
| 6,712,061 | B1 | 3/2004 | Kalb |
| 8,056,549 | B1 | 11/2011 | Fleetwood |
| 9,505,099 | B2 | 11/2016 | Richardson |
| 2003/0114092 | A1 | 6/2003 | Rupprecht et al. |
| 2008/0132155 | A1 | 6/2008 | Thysell |
| 2008/0292399 | A1 | 11/2008 | Freeburn |
| 2012/0100783 | A1 | 4/2012 | Itoyama et al. |

OTHER PUBLICATIONS

Chinese Office Action for Application No. 201580000280.9 dated Feb. 23, 2018.

* cited by examiner (BEFORE)

(AFTER)

METHOD AND APPARATUS FOR APPLYING A UNIFORM TEXTURE TO A SUBSTANTIALLY VERTICAL SURFACE

CROSS REFERENCE TO RELATED APPLICATION

This application is a continuation-in part of and claims the benefit of and priority to U.S. patent application Ser. No. 15/362,269 entitled "METHOD AND APPARATUS FOR APPLYING A UNIFORM TEXTURE TO A SUBSTANTIALLY VERTICAL SURFACE," filed on Nov. 28, 2016, and a continuation-in part of and claims the benefit of and priority to U.S. patent application Ser. No. 14/605,708 entitled "METHOD AND APPARATUS FOR APPLYING A UNIFORM TEXTURE TO A SUBSTANTIALLY VERTICAL SURFACE," filed on Jan. 26, 2015 and U.S. Provisional Application 61/995,586 entitled "METHOD AND APPARATUS FOR RETEXTURING/REFINISHING A SUBSTANTIALLY VERTICAL SURFACE," filed on Apr. 15, 2014, which are hereby incorporated by reference in their entirety, as if fully set forth herein.

FIELD OF DISCLOSURE

The present disclosure, relates generally to a method and apparatus for applying an even texture or finish, to, and/or polishing or buffing, a substantially vertical surface.

BACKGROUND

The art of texturing or polishing a horizontal concrete surface, such as a floor, is well known. In this instance, the weight of the apparatus applying the texture remains constant under the uniform force of gravity producing a flat level polished surface. Heretofore, applying a texture to, and/or polishing, a vertical surface has been accomplished by hand holding the apparatus against the surface of the wall. However, texturing or polishing a vertical surface in this fashion lacks the benefit of gravity to exert a uniform and even force across the surface, which results in a wavy or undulating finished surface due to the operators inability to apply a constant and uniform pressure.

SUMMARY

The present disclosure is directed to an apparatus, system and method for texturing, polishing, buffing or otherwise finishing (referred to herein generally as "texturing") a vertical surface, such as but not limited to a vertical wall surface. In one or more embodiments, the present disclosure is directed to an apparatus, system and method for exerting a substantially constant pressure to a texturing head juxtaposed to and in contact with a work surface. The work surface can be a substantially vertical surface to be textured. In some embodiments, the work surface is a surface of a wall comprising the face of a poured concrete wall, but is not limited to concrete or to a wall. In various embodiments, the work surface can be a slanted surface, curved surface, or pillar.

In an embodiment an apparatus is provided for texturing a working surface comprising: a frame and a slide; the slide including a texturing head, the texturing head including at least one finishing pad, the at least one finishing pad configured to be movable across a work surface; a motor configured to move the at least one finishing pad across the work surface; the slide mounted to the frame substantially perpendicular to the work surface and configured to be movable with respect to the frame towards and away from the work surface; and a tensioning device configured to provide a relative pressure between the frame and the slide to thereby control the pressure of the finishing pad against the work surface.

In an embodiment a system is provided comprising: a carriage, the carriage including a frame and a slide; the slide including a texturing head, the texturing head including at least one finishing pad, the at least one finishing pad configured to be movable across a work surface; a motor configured to move the at least one finishing pad across the work surface; the slide mounted to the frame substantially perpendicular to the work surface and configured to be movable with respect to the frame towards and away from the work surface; and a tensioning device configured to provide a pressure between the frame and the slide for controlling the pressure of the at least one finishing pad against the work surface.

In any one or more aspects the apparatus or system, or both, can further include a track assembly configured to allow movement of the carriage or frame along the track assembly from one location of the work surface to another location of the work surface. A lift mechanism can be included, the lift mechanism configured to raise and lower the texturing head in relation to the work surface. The lift mechanism can include a first end configured to contact a floor or ground surface and a second end connected to the carriage or frame, and the track assembly can be connected to the second end of the lift mechanism. The track assembly can include at least one track configured for placement substantially planar to the work surface. The track assembly can be positioned substantially perpendicular to the slide. The motor can be pivotally attached to the texturing head. The tensioning device can be configured to provide a substantially constant pressure of the at least one finishing pad against the work surface. The slide can further include a pair of arms and the texturing head can be attached between a first end of the pair of arms, and a cross-member can be attached between a second end of the pair of arms against which the tensioning device can provide the pressure between the slide and the frame.

In an embodiment, a method is provided for texturing a surface. The method can include a) providing the present apparatus or system in any one or more aspects. The method can further include: b) positioning the frame in relation to the work surface and placing the finishing pad in contact with the work surface; c) adjusting a pressure of the tensioning device to apply a desired pressure of the finishing pad against the work surface; d) using the motor to move the finishing pad across the work surface; and e) moving the frame in a path across the work surface while maintaining the finishing pad in contact with the work surface and while using the motor to move the finishing pad across the work surface.

In any one or more aspects, the method can further include sliding the slide towards and/or away from the work surface to position the finishing pad in contact with the work surface or retract the finishing pad away from the work surface or both. The texturing device can include a track assembly configured to allow movement of the frame along the track assembly from one location of the work surface to another location of the work surface, and the method can further include the step of moving the frame along the track assembly from one location of the work surface to another location of the work surface. The texturing device can include a lift mechanism configured to raise and lower the carriage in relation to the work surface, and the method can further include the step of using the lift mechanism to position the finishing pad in relation to the work surface. The tensioning device can be used to provide the desired pressure by providing pressure between the slide and the frame.

In any one or more aspects of the apparatus, system and/or method, the work surface can be a surface of a wall, for example a substantially vertical surface. The at least one finishing pad can be at a polishing pad, a buffing pad, a sanding pad, and/or a texturing pad for providing a desired texture to the work surface. The pressure between the finishing pad and the work surface can be a substantially constant pressure. The finishing pad can be moved in a direction substantially planar to the work surface. The frame can be moved in a path generally parallel to the work surface, either horizontally, vertically, or both, or anywhere in between horizontal and vertical.

Thus, in one or more aspects, a texturing or surfacing apparatus is provided that can be positioned or supported adjacent a substantially vertical surface of a structure for applying an even and uniform texture to the surface of the structure using a selectively adjustable force exerted on a texturing means to engage the surface of the structure. The texturing apparatus is suited for horizontal and vertical movement in controlled prescribed paths under controlled and prescribed pressure from the adjustable tensioning means to provide the desired texture to the structure.

In an embodiment a texturing head is provided for a surfacing apparatus comprising. The texturing head can comprise: at least one texturing bit, the at least one texturing bit including a finishing pad configured to be movable across a work surface; a base plate; and a pivot device coupling the at least one texturing bit to the base plate, the pivot device configured to allow the texturing bit to conform to the contour of the work surface.

In any one or more aspects the texturing head or apparatus, or both can further include at least one finishing pad configured to be movable across a work surface. A motor can be configured to move the at least one finishing pad across the work surface. The texturing bit can include: a bit plate; one or more pivot members; a pivot block; and a pivot shaft; wherein the one or more pivot members can be attached to the at least one bit plate and the pivot block is attached to a base plate. The texturing bit can include at least one spring positioned between the pivot members and the bit plate. The texturing bit can include: a bit plate; a ball post; and a socket; wherein the socket is attached to the bit plate and the ball post can be mated with the socket. The ball post can be attached to a base plate. The texturing bit can include a post seat attached to a base plate and a spring disposed between the post seat and the ball post.

In any one or more aspects, the texturing bit can include: a bit plate, a spring, and a spring seat; wherein the spring is secured to the bit plate and the spring seat allowing movement of the at least one finishing pad. The spring can have an uncompressed length longer than the height of the spring seat allowing a clearance between the bottom of the bit plate and the top of the spring seat. In any one or more aspects, the texturing bit can include: a bit plate and a cross-shaped pivot member; wherein the cross-shaped pivot member can be secured along one axis to a base plate and the cross-shaped pivot member secured along an orthogonal axis to the bit plate. The texturing head can include a tensioning device configured to provide a substantially constant pressure of the at least one finishing pad against the work surface, wherein the work surface is a surface of a wall or column. The texturing head can further comprise a lift mechanism configured to raise and lower the texturing head in relation to the work surface. The texturing head for a surfacing apparatus can include a motor pivotally attached to the texturing head.

In an embodiment, a method is provided for texturing a surface. The method can include: a) providing a texturing device, the texturing device comprising: a texturing head comprising: at least one texturing bit, the at least one texturing bit including a finishing pad configured to be movable across a work surface; a base plate; and a pivot device coupling the at least one texturing bit to the base plate, the pivot device configured to allow the texturing bit to conform to the contour of the work surface; and a motor configured to move the at least one finishing pad across the work surface; b) positioning the texturing head in relation to the contoured work surface and placing the finishing pad in contract with the work surface; c) adjusting a pressure of the texturing head to apply a desired pressure of the finishing pad against the work surface; d) using the motor to move the finishing pad across the work surface; and e) moving the texturing head including the finishing pad in a path across the work surface while maintaining the finishing pad in contact with the work surface and while using the motor to move the finishing pad across the work surface.

In any one or more aspects, the method can further include a texturing device that includes, a tensioning device configured to provide a substantially constant pressure of the at least one finishing pad against the work surface, wherein the work surface is a surface of a wall. The work surface can be a concave surface. The work surface can be a convex surface. The work surface can be a column.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE DRAWINGS

Many aspects of the present disclosure can be better understood with reference to the following drawings. The components in the drawings are not necessarily to scale, emphasis instead being placed upon clearly illustrating the principles of the disclosure. Moreover, in the drawings, like reference numerals designate corresponding parts throughout the several views.

A full and enabling disclosure of the present disclosure, including the best mode thereof, directed to one of ordinary skill in the art, is set forth more particularly in the remainder of the specification, which makes reference to the appended FIGS. in which.

Figure 1:
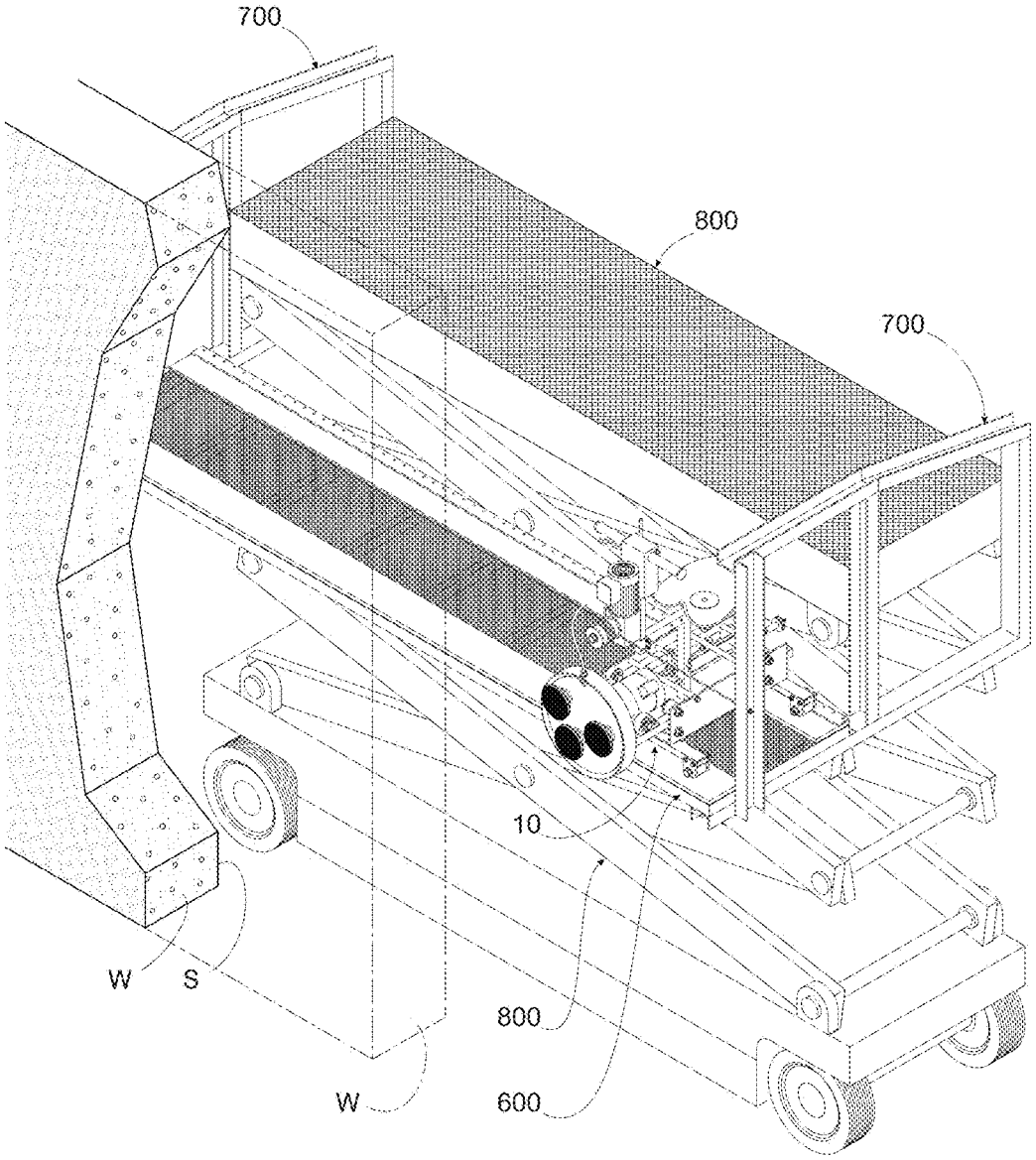
FIG. 1 is an isometric view of the overall constant pressure texturing apparatus suspended from a lift adjacent the surface of a wall to be textured.

Repeat use of reference characters in the present specification and drawings is intended to represent the same or analogous features or elements of the disclosure.

DETAILED DESCRIPTION

Described below are various embodiments of the present systems and methods for texturing a surface, for example a substantially vertical surface. Although particular embodiments are described, those embodiments are mere exemplary implementations of the system and method. One skilled in the art will recognize other embodiments are possible. All such embodiments are intended to fall within the scope of this disclosure. Moreover, all references cited herein are intended to be and are hereby incorporated by reference into this disclosure as if fully set forth herein. While the disclosure will now be described in reference to the above drawings, there is no intent to limit it to the embodiment or embodiments disclosed herein. On the contrary, the intent is to cover all alternatives, modifications and equivalents included within the spirit and scope of the disclosure.

The present disclosure provides a variety of texturing devices that when positioned in front of a working surface provide a constant pressure between the texturing device and the working surface. In various aspects the working surface can be a substantially vertical surface. A variety of movement configurations allow the texturing device to move planar to a substantially vertical surface, for example, a wall. Additionally, a variety of controls allow either a user or computer to operate the texturing device. The controls can include moving the texturing device planar to the working surface, moving the texturing device toward and away from the working surface, and varying the tension applied to the texturing device to vary the pressure between the texturing device and the working surface, preferably to cause the texturing device to apply a constant pressure against the working surface. Additionally, in various aspects a method is provided for applying a uniform texture to a working surface, such as a substantially vertical surface.

Reference will now be made in detail to various embodiments of the disclosure, one or more examples of which are illustrated in the drawings. It is intended that the present disclosure include these embodiments and other modifications and variations as will be obvious to one skilled in the art.

Depicted in FIG. 1, is an example of a texturing device or apparatus 10 of the present disclosure. In this first embodiment, the texturing device can include a traversing texturing carriage 100. The texturing carriage can be configured to traverse atop a track 600 which can be supported by arms 700 fixed to, and extending from, a lift mechanism 800, in this instance, a scissor lift. The texturing device 10 can be positioned adjacent the surface S of a wall W to be textured. Generally, in operation, the traversing texturing carriage 100 traverses a linear section of the structure W. For example, it can travel from side to side atop the track 600 in contact with the surface S of the wall W to be textured. The contact with the surface S can be under a constant contact as described below.

Figure 2:
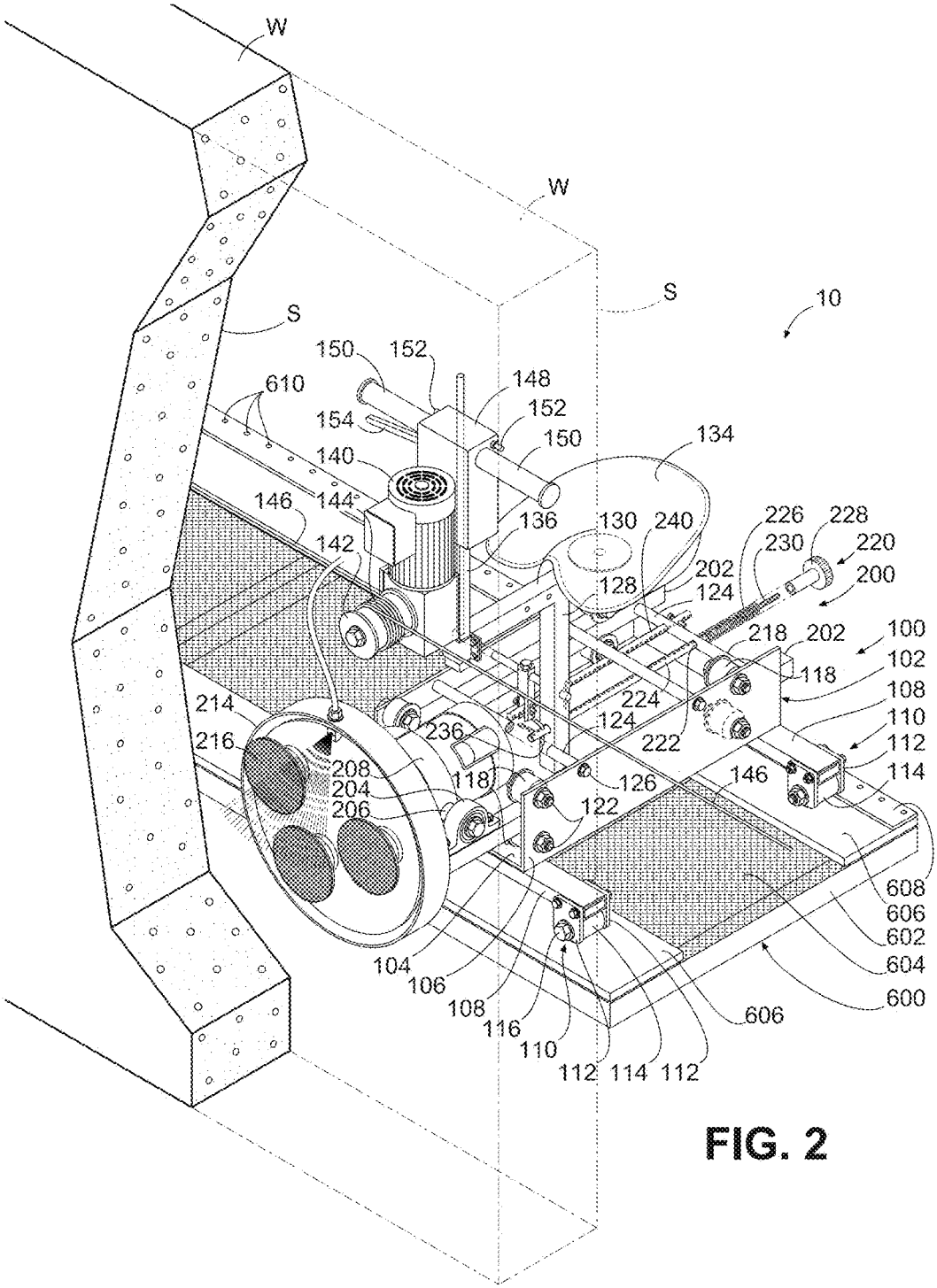
FIG. 2 is an enlarged isometric view of the texturing head on a carriage atop a traversing track adjacent a wall fragment to be textured.
Figure 3:
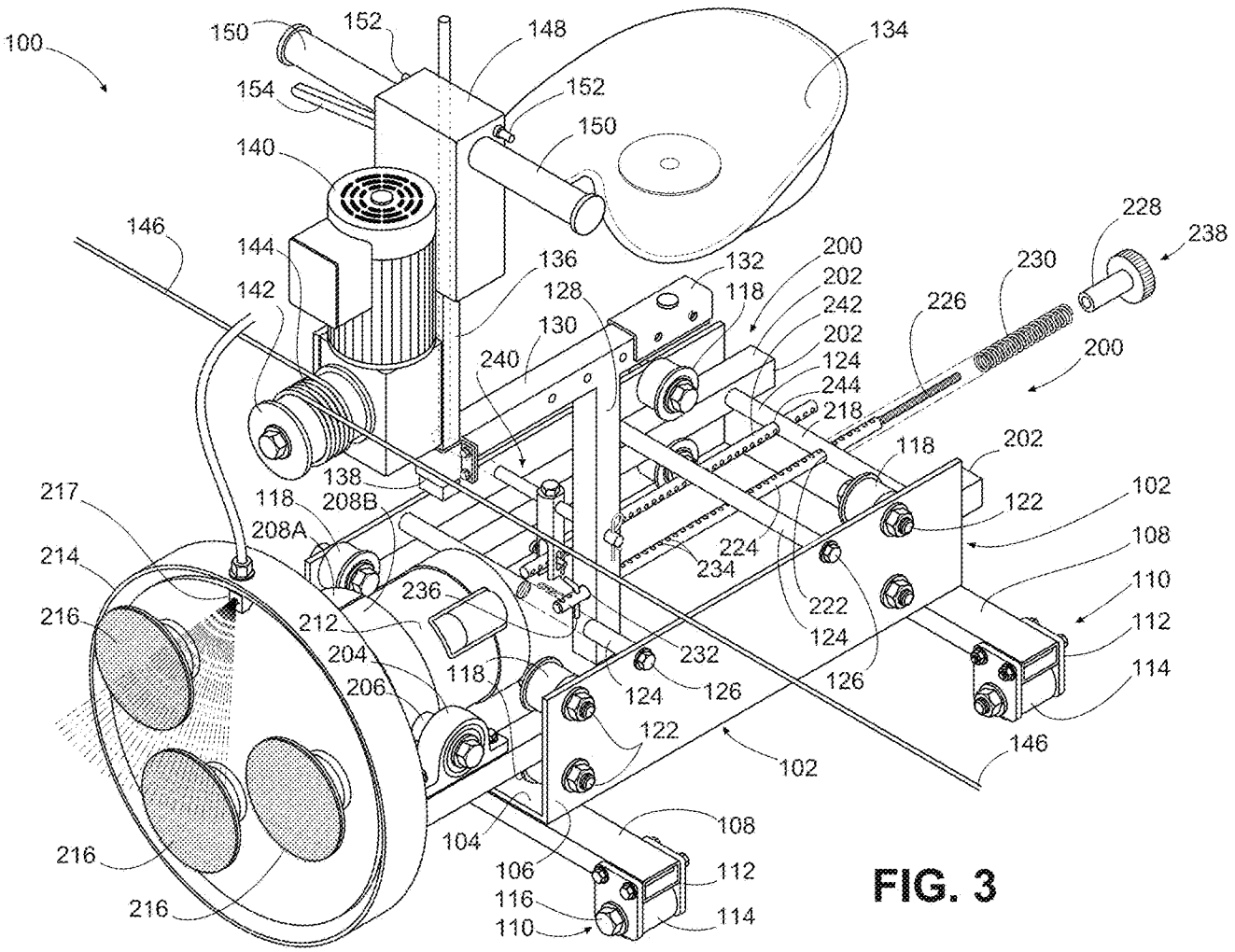
FIG. 3 is a further enlarged isometric view of the traversing carriage suited with a texturing head.
Figure 4:
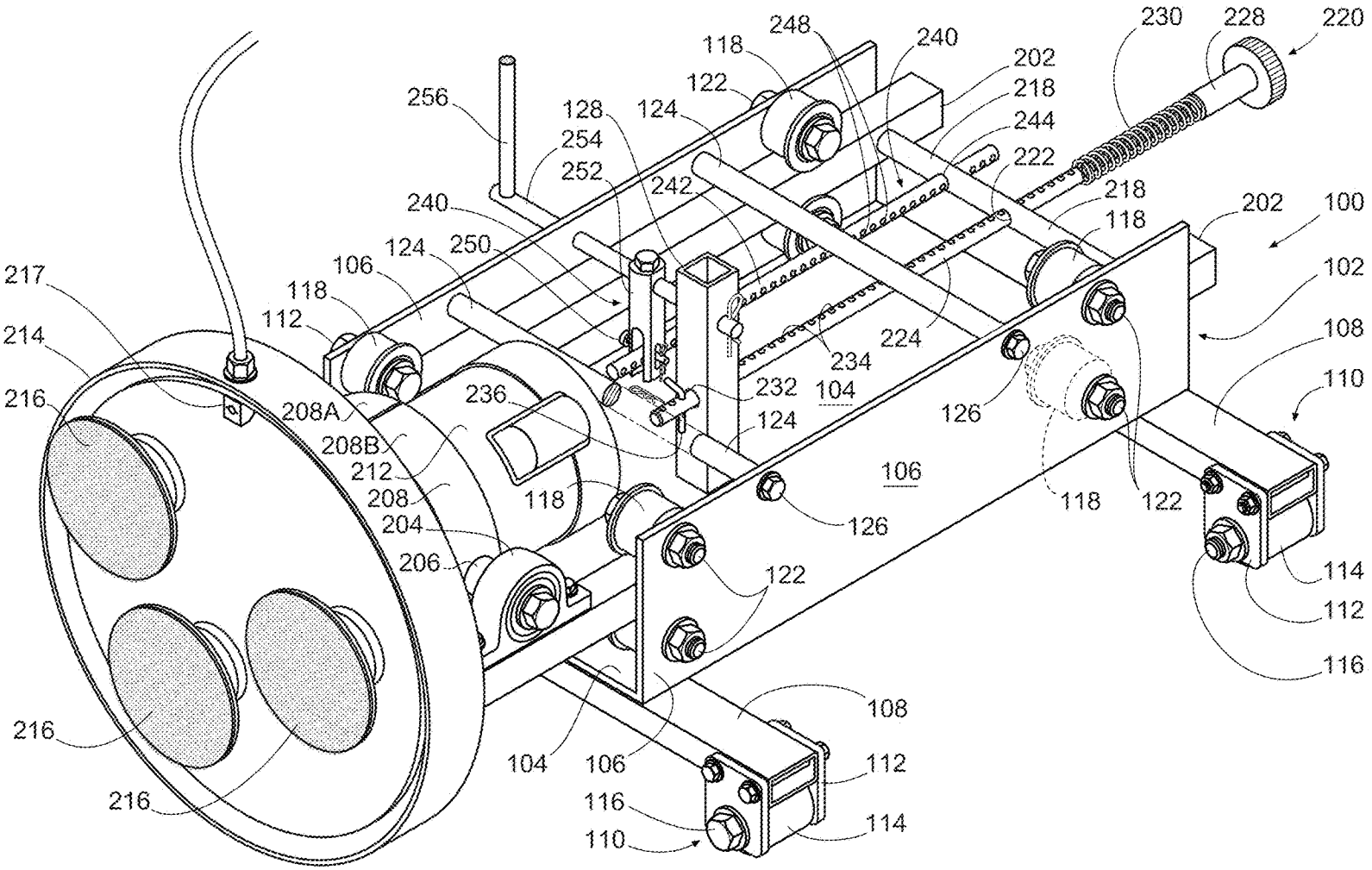
FIG. 4 is a still further enlarged isometric view of the traversing carriage with portions removed for clarity.

Seen more clearly in the enlarged FIGS. 2 through 4, the traversing carriage 100 can consist of a frame 102. The frame 102 can be configured to allow the traversing carriage 100 to traverse a linear section of the structure W. The frame 102 can be a U-shaped frame. The U-shaped frame can be formed by a bottom plate 104 joined to upwardly extending juxtaposed side plates 106. Fore and aft runners 108 can be attached to the bottom plate 104 of the frame 102. At their distal ends, the runners 108 can be suited with roller assemblies 110. The roller assemblies 110 can consist of downwardly projecting wheel mounting plates 112 with wheels 114 journaled for rotation by axles 116. Each side plate 106 of frame 102 can be suited, for example, fore and aft, with inwardly projecting juxtaposed pairs of flanged rollers 118 fixed to and journaled for rotation on the side plates 106 by axle bolts 122. At the upper edges of side plates 106 are support spanners 124 attached by bolts 126.

Fixed on the bottom plate 104, for example at a mid-point, can be an upwardly extending support column 128. A horizontal support beam 130 can be attached to the top of column 128 and form a T therewith. A portion of support beam 130 can extend to the rear and support a selectively adjustable seat bracket 132 which can be attached to an operator seat 134. At an opposite end of support beam 130, a mounting post 136 can be attached by a bolted bracket 138. The bracket can allow for selective vertical adjustment of the post 136.

Fixed to the post 136 can be a motor 140. The motor 140 provides a motive force for moving the traversing carriage 100 across a linear section of the structure W. In an aspect the motor 140 can be a reversible gear head motor. Attached to the output shaft of motor 140 can be a drive spool 142. Wound around spool 142 can be several loops 144 of a cable 146. The cable 146 can be fixed at distal ends to the arms 700 which are attached to the lift mechanism 800. Attached to the top of the support post 136 can be a housing 148 containing electrical circuitry. Extending left and right from the housing 148 can be operator grip handles 150. Also extending left and right from the housing 148 can be controls, for example, "travel right" and "travel left" button switches 152. The controls can be sued to actuate the motor 140 and to actuate movement of the traversing carriage 100 across the structure W.

Extending from the housing 148 and in close proximity to the operator's right handle can be a lever 154 connected to an electrical switch (not shown). In operation, lever 154 can be held in contact with the right handle 150. The closed position of lever 154 against the handle 150 can enable an electrical connection to be maintained for the traversing motor 140 and texturing motor, to be described. The previously described rollers 118 can be spaced apart to receive the arms 202 of a texturing head slide 200 between roller pairs such that arms 202 can be adapted to slide in a linear path defined by the rollers 118.

Figure 5:
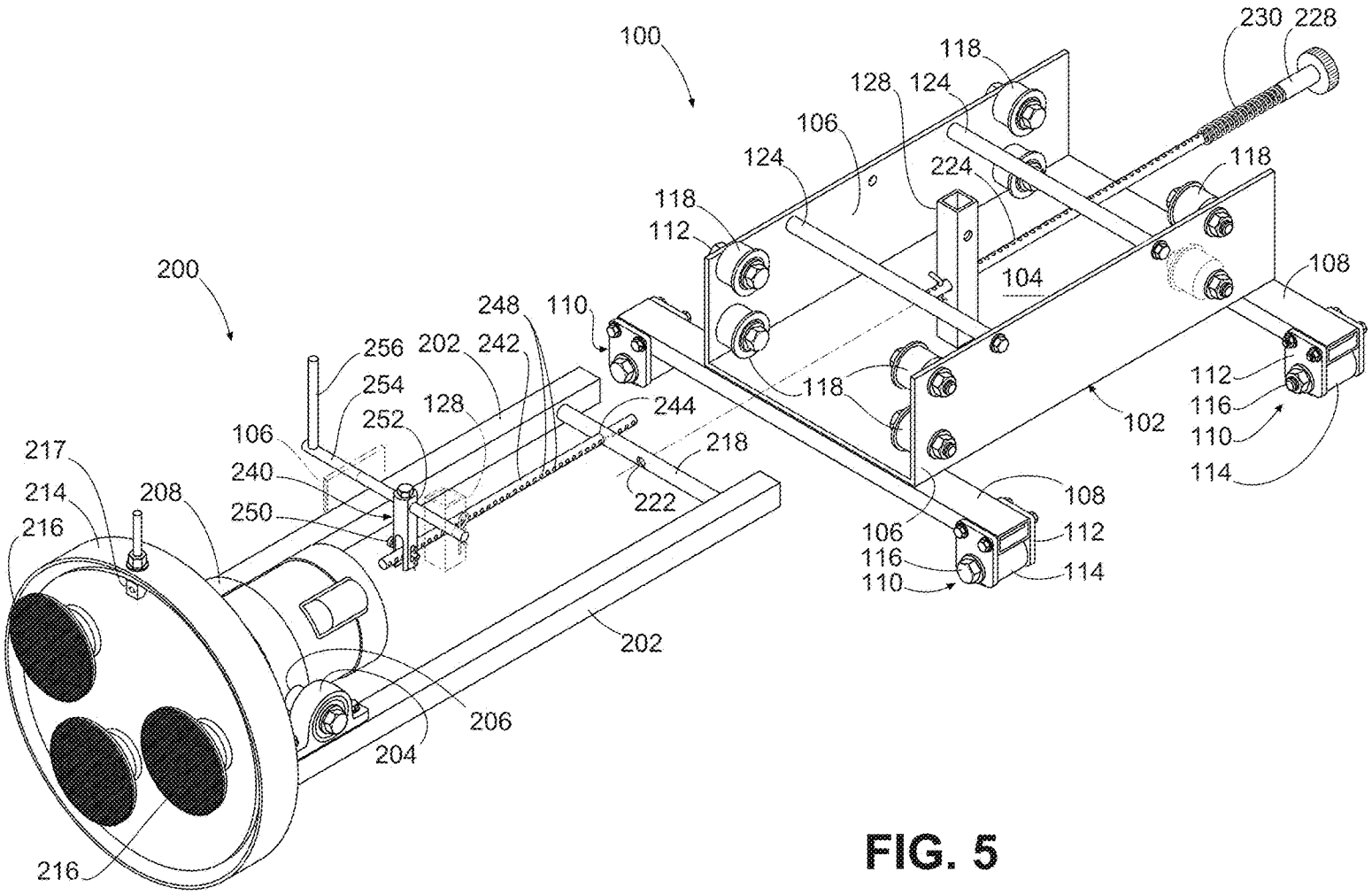
FIG. 5 is an isometric view of the texturing head frame exploded away from the carriage frame.
Figure 6:
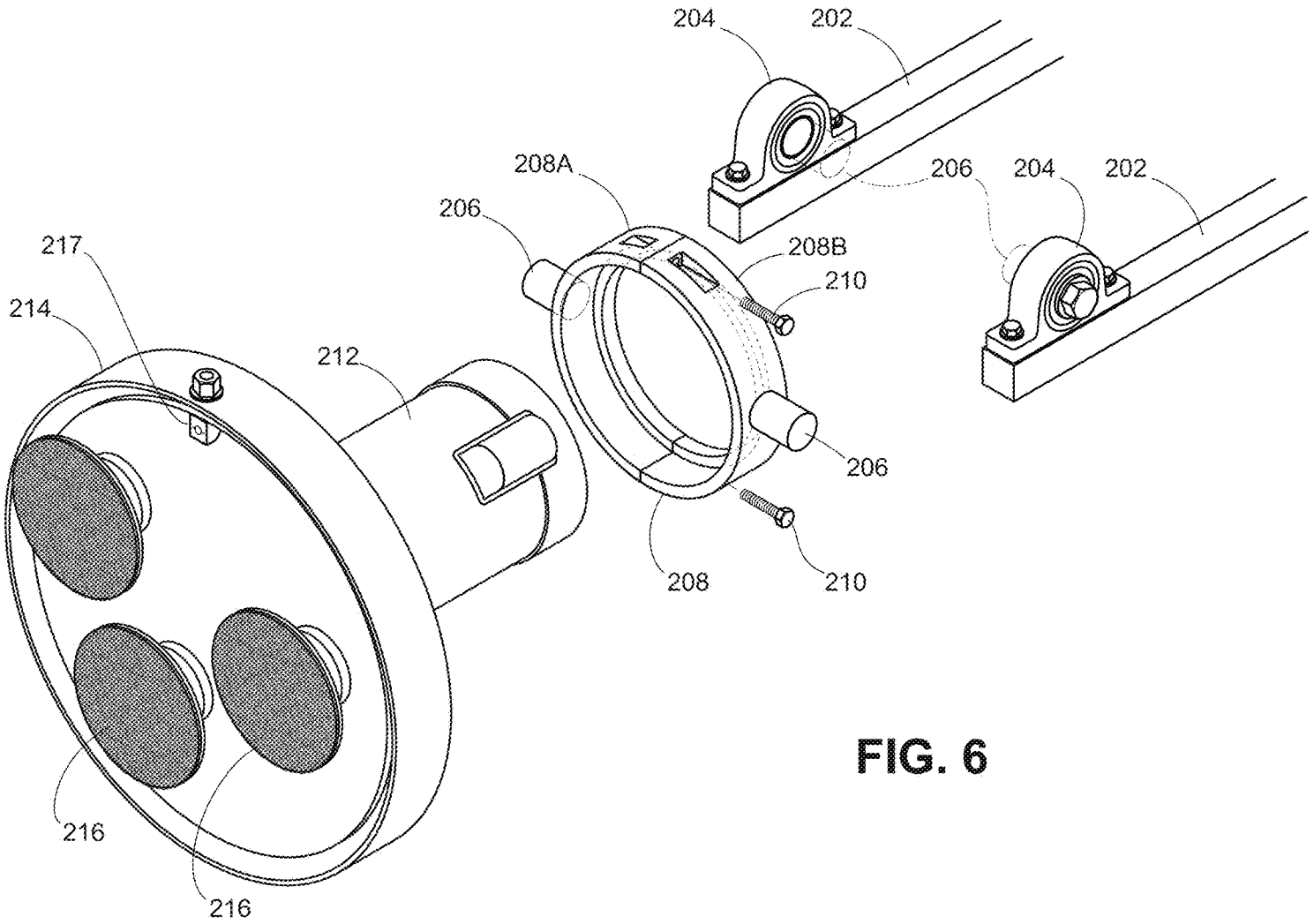
FIG. 6 is an isometric view of the texturing head exploded away from the head frame.

Mounted or attached to one end of texturing slide 200 is a texturing head 214. Texturing slide 200 is configured to provide movement of texturing head 214 towards and away from the structure W, in particular surface S. In an aspect, shown best in FIGS. 4 through 6, the texturing slide 200 can be suited with a pair of arms 202. Each of the arms 202 can be suited with juxtaposed pillow blocks 204 that telescopically receive the trunnions 206 that can extend from a split collar 208. The split collar 208 can consist of two portions 208A and 208B which can be fastened by bolts 210 to pinch and thereby secure a portion of the motor 212 of a finishing head, for example, a conventional grinding, polishing, or texturing head 214.

The texturing head 214 can be a conventional texturing head. In an aspect, it can be suited with one or more conventional rotating polishing tips or pads 216. Attached to arms 202 at an opposite end of texturing head 214 can be a cross-member 218 that can be attached to each arm 202. Cross-member 218 can serve not only to provide structural rigidity to the rear structure of arms 202 but more importantly, can provide an attachment point on the texturing slide 200 for a tensioning assembly 238 (FIG. 3).

The texturing device 10 includes a tensioning device assembly 238. The tensioning device 238 is configured to allow adjustment of the pressure between the texturing head 214, in particular a finishing pad 216 on the texturing head 214, and the working surface S, preferably to cause the texturing head 214 of the texturing device 10 to apply a substantially constant pressure against the working surface S. In an aspect the texturing device 238 can include a tensioning member 224. A bore 222 through the cross member 218 telescopically can receive the tensioning member 224, for example, a tensioning rod. Tensioning rod 224 can be suited, at its distal end, with a threaded rod 226 (FIG. 3) which can be engaged by a complimentary internally threaded tensioning nut 228. Surrounding, axially aligned and concentric with the rod 224 can be a tensioning spring 230 which can be sandwiched between the nut 228 and the cross-member 218 through which the rod is free to slide. The spring 230 can be compressed against the outer surface of the cross-member 218 by the tensioning nut 228. The tensioning rod 224, at its opposite end, can be telescopically received through an aperture 232 in the column 128 which can be fixed to the bottom plate 104 of frame 102. Tensioning rod 224 can be suited with a plurality of bores 234 for selectively receiving a pin 236 which can be inserted into the proper bore 234 to position texturing tips or pads 216 on the texturing head 214 into frictional engagement with the surface S of the structure W to be textured. Pin 236 retaining tension rod 224 in position against column 128 under tension from the spring 230 can urge the texturing slide 200 against the surface S of structure W. A desired tension can thereby be applied to the texturing assembly 238 by adjustment of the tensioning nut 228 on tensioning rod 224 to compress or relax the tensioning spring 230 to achieve a desired substantially constant pressure of the texturing apparatus 10 against the surface S of the wall W.

As seen generally in FIG. 1, the texturing carriage 100 (FIG. 2) can travel in a path along and in engagement with a portion of the surface S of structure W atop track 600. The path can be a linear path. At the end of a run, or texturing path, the texturing head 214 (FIG. 2) can be disengaged from the surface S by a disengaging mechanism 240. The texturing head 214 can then be moved for engagement with another section of surface S for another run or texturing path.

Texturing device 10 can include a lift mechanism 800 for raising or lowering the texturing head 214 for engagement with another section of surface S. In an aspect, the lift mechanism 800 can elevate the texturing carriage via arms 700 connected to a track 600. The disengaging mechanism 240 can be suited with a disengagement rod 242 that can be telescopically received through a bore 244 in the cross-member 218, and secured by a pin 246. The pin 246 can be placed in the selected bore 248 of a plurality of bores 248 along the disengagement rod 242. The opposite end of the disengagement rod 242 can be secured by a pin 250 through one aperture, or bore 248, in the rod 242 to a yoke 252. The opposite end of yoke 252 can be attached to a shaft 254 that is journaled between the support column 128 and a side plate 106 of the frame 102. The shaft 254 can extend outwardly from the side 106 of frame 102 and can be connected to a disengagement lever 256. Upon reaching the end of a travel run or path, the lever 256 can be pulled back by the operator to retract the texturing head 214 out of engagement with the surface S of the wall W. This can be done manually by the operator or through controls. Alternately, the disengagement mechanism 240 may be engaged to retract the head 214 away from surface S for many various reasons such as replacing worn tips or pads 216, changing to a new grit, etc.

The operation of the various texturing devices is further discussed. It should be appreciated that although elements of a specific embodiment may be discussed, the operation can be completed with similar elements in the other embodiments. The texturing process can involve positioning the lift mechanism 800 in front of a work surface, illustrated as surface S of wall W in FIG. 1. In some embodiments, the lift mechanism 800 can be moved by an operation, for example, by pushing on the lift mechanism 800, to rotate the attached wheels and align the lift mechanism 800, in particular the texturing head 214 and the one or more pads 216, with the work surface S. In other embodiments, the lift mechanism 800 can be moved by a motor controlled by an operator. In other embodiments, the lift mechanism 800 can be programmed with software to sense the work surface and move itself into a position parallel to the work surface. In yet other embodiments, the process can involve positioning the texturing head 214 of texturing apparatus 10 by manually placing it substantially parallel to the work surface.

The process can involve adjusting the pressure of the one or more finishing pads 216 against the work surface S using a tensioning device. In some embodiments, the tensioning device can be the aforementioned tensioning assembly 238, and the tension can be adjusted by rotating a tensioning nut 228 on a tensioning rod 224 to compress a tension spring 230. In other embodiments, the tensioning device can be adjusted by rotating threaded nut 426 on tensioning rod 424 to compress a tensioning spring 428. Further, in some embodiments, the tensioning device can be configured to provide the pressure by providing a constant pressure between the texturing slide 200 and the texturing carriage 100. In other embodiments, the tensioning device can provide a constant pressure between post 422 and post 430.

The process can also involve rotating one or more finishing pads 216 mounted on a texturing head (e.g. 214 or 440). The finishing pad(s) can comprise at least one of: a polishing pad, a buffing pad, a sanding pad(s), or a texturing pad 216. In some embodiments, a spray nozzle 217 can also be utilized to reduce heat and/or friction on the work surface S during texturing of the work surface S and to remove debris from the work surface. The spray nozzle 217 can be mounted on texturing head 214 and mounted at an angle directed outward from the texturing head 214. The spray nozzle 217 can be configured to expel water or another liquid during operation of the finishing pads.

The process can further involve moving the texturing carriage 100 across the work surface. In various aspects, the movement can be side to side across the work surface S, for example along a substantially horizontal axis across work surface S. In some embodiments, this can be accomplished by rotating a traversing motor 140 to rotate a cable 146 attached at the distal ends to the lift mechanism 800 directly. In other embodiments, the cable 146 can be attached to track mounting arms 700. The traversing motor can be controlled by a set of travel direction buttons 152. In some embodiments, travel controls, for example a set of travel direction buttons 152, are only functional when an operating lever is engaged. In other embodiments, a carriage slide can be moved along a track by an operator pushing a handle (e.g. T-Handle 412).

The process can also involve sliding the texturing slide 200 to bring the texturing head 214 into and out of engagement with work surface S. In an aspect the texturing slide 200 can be moved along a track on the texturing carriage 100 to retract the finishing pad 216 from the work surfaces by manipulating a disengagement mechanism 240. This can be accomplished by an operator pulling on lever 256 as discussed above or through other controls.

The process can also involve raising and lowering the texturing carriage 100 substantially adjacent to the work surface S by engaging a lift mechanism, for example lift mechanism 800. In some embodiments, this can be accomplished by moving a scissor lift up and down. In other embodiments, this can be accomplished by extending a hydraulic piston to lift the texturing carriage 100.

Figure 7:
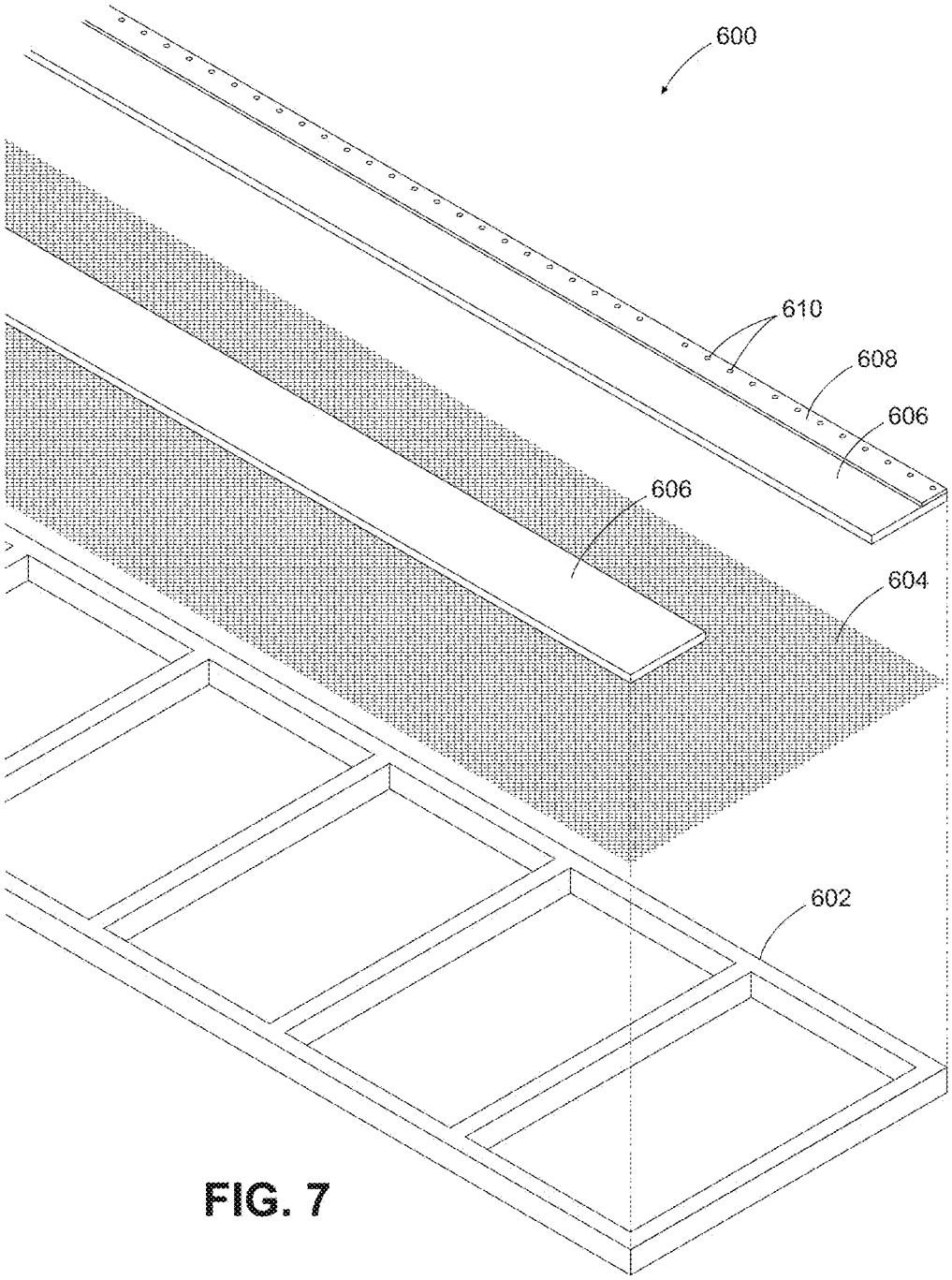
FIG. 7 is an exploded isometric view of the traversing track upon which the carriage traverses.

As previously stated, the texturing carriage 100 can be suited with traversing wheels 114 that support the carriage for linear movement atop the track 600. Track 600, shown in more detail in FIG. 7, can consist of a frame 602 upon which can be mounted an expanded metal deck 604. One or more wheel tracks 606 can be mounted on deck 604, for example, a pair of wheel tracks, which provide a linear surface upon which wheels 114 can traverse. Fixed atop the back track, away from structure W, can be a biasing bar 608. The biasing bar 608 can be suited with a plurality of apertures 610 that receive screws (not shown) for adjustably securing the bar to the rear wheel track 606. In operation, biasing bar 608 can be in constant contact with a lower portion of the sidewall of rear (away from the wall) wheels 114. Contact with the bar 608 by wheels 114 can maintain a fixed spatial relationship between the wall W and the texturing carriage 100.

Figure 8:
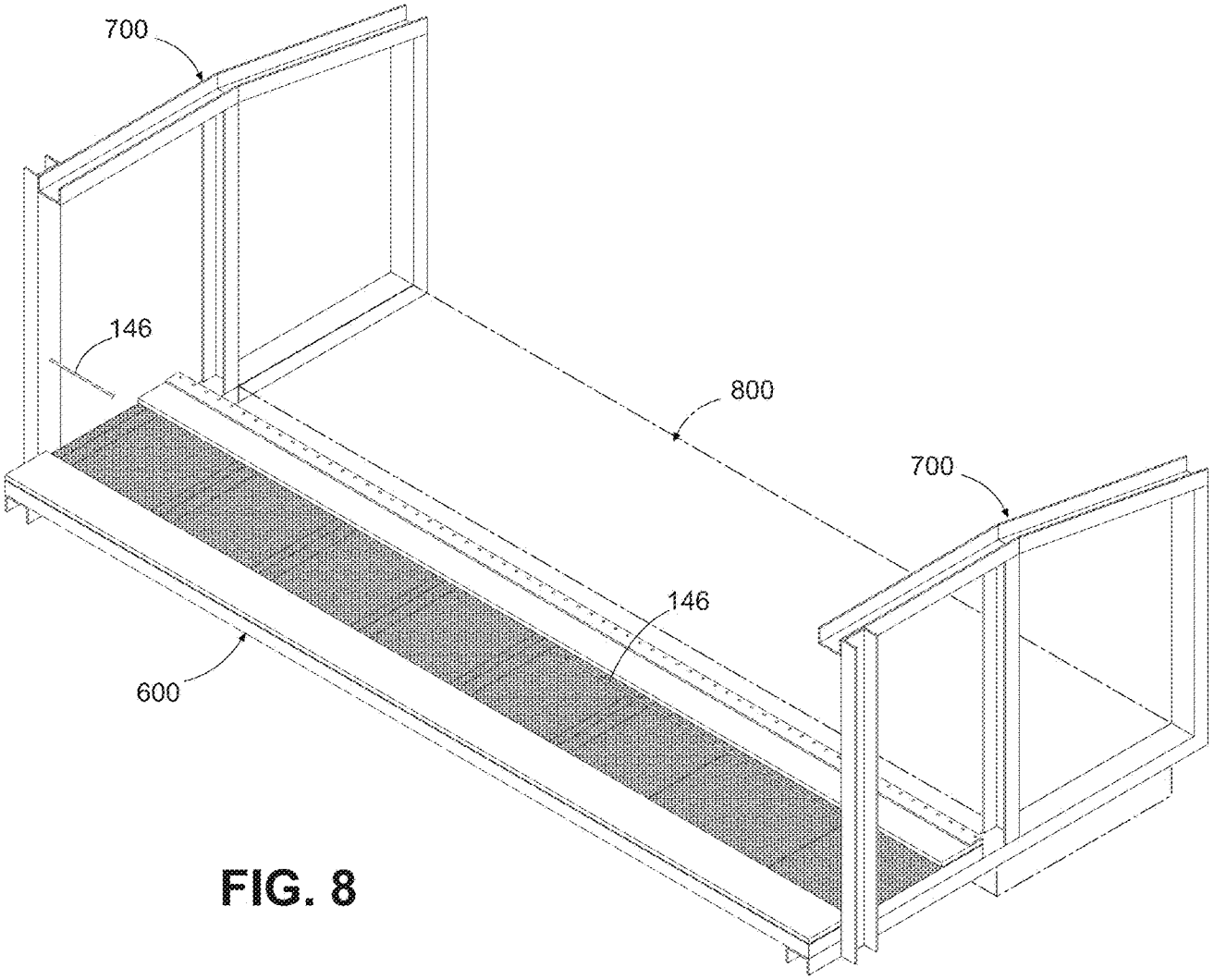
FIG. 8 is an isometric view of the arms attached to a scissor lift that support and suspend the track upon which the texturing carriage traverses.

With reference to FIG. 8, track 600 can be supported by D-shaped arms 700 which can be fixed to each end of a lift mechanism 800, in this instance, a scissor lift. With each successive linear pass of the texturing carriage 100, the lift mechanism 800 can be raised, for example incrementally, to position the texturing assembly 238 at a new elevation for a pass along a new section of surface S of the wall W. The process of sweeping the texturing apparatus 10 and repositioning at a raised elevation by the lift 800 can be repeated until the desired effect is achieved across the surface S of the structure W. The pass(es) can be linear passes or sweeps across surface S.

Figure 9:
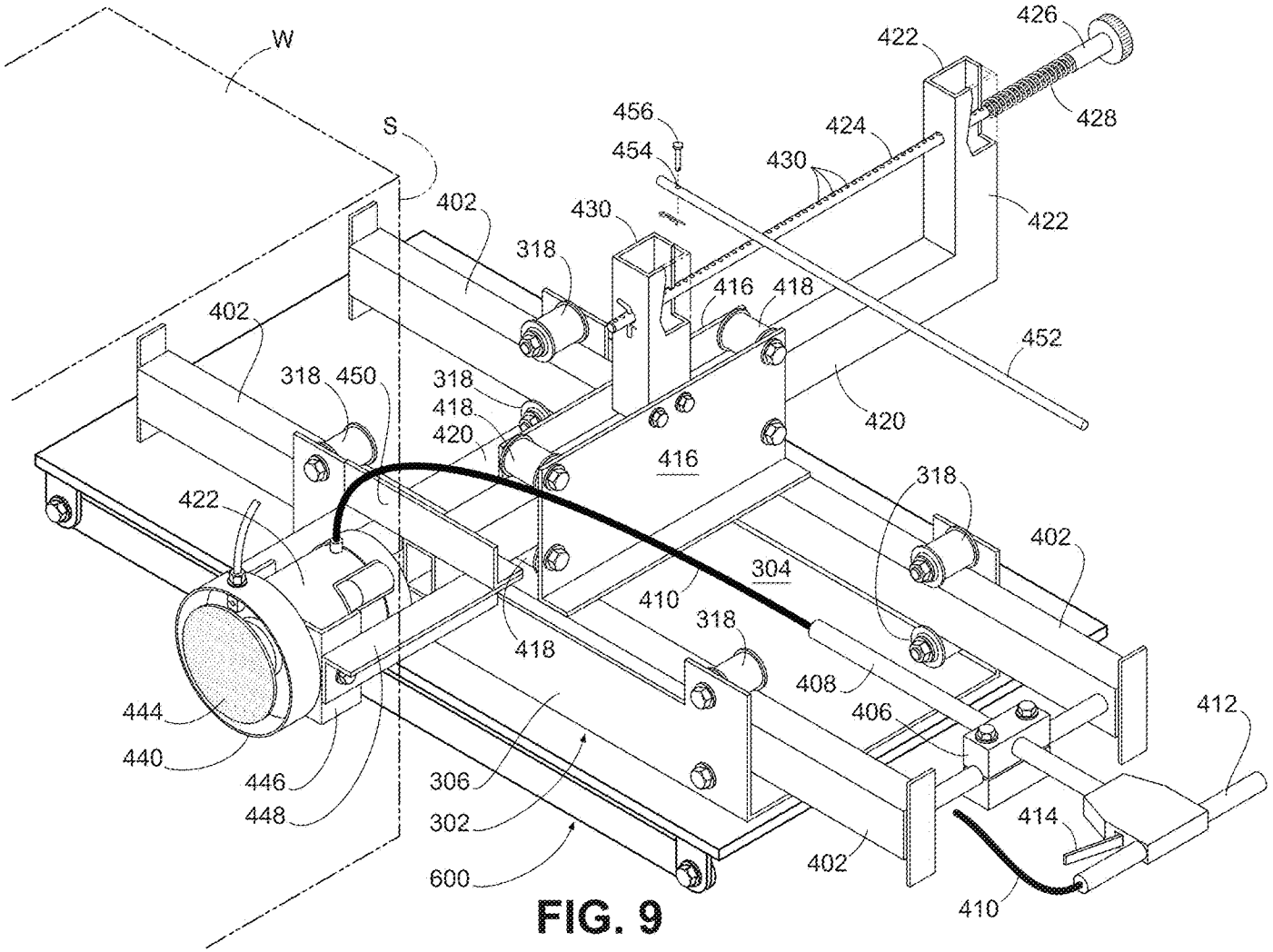
FIG. 9 is a partially exploded isometric view of an alternate embodiment of the constant pressure texturing apparatus.
Figure 10:
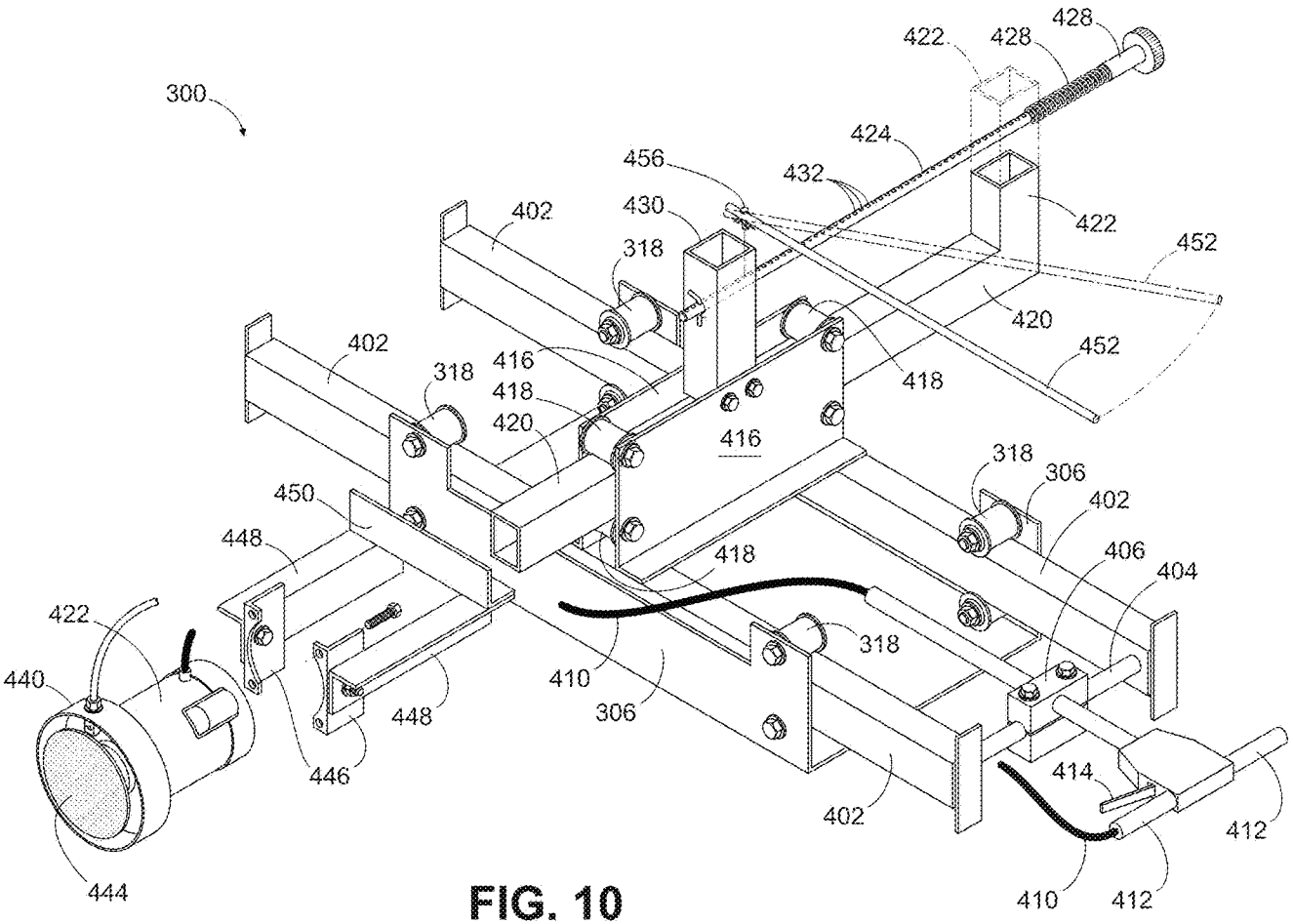
FIG. 10 is a further exploded isometric view of the embodiment of FIG. 9.
Figure 11:
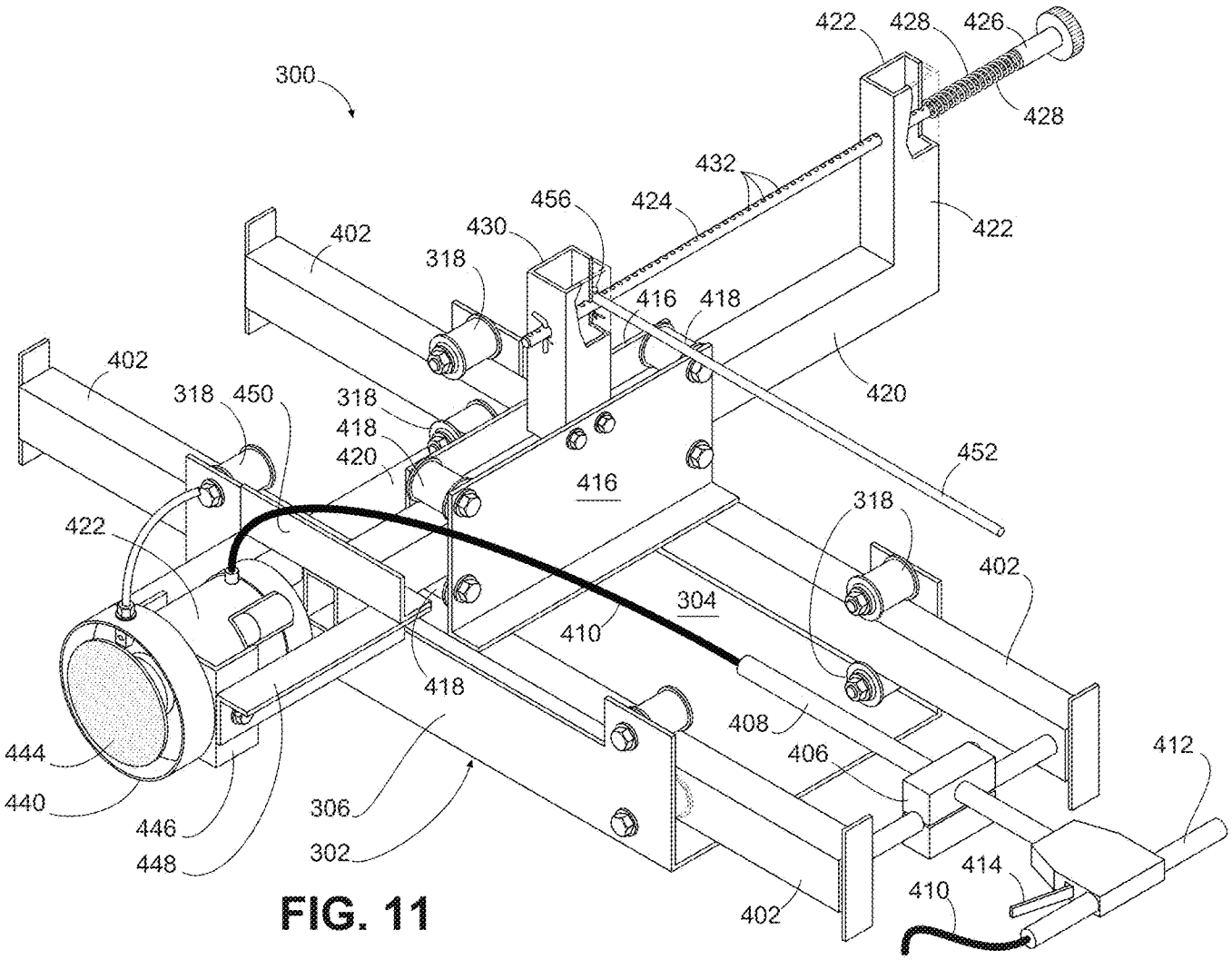
FIG. 11 is an isometric view of the embodiment shown in FIGS. 9 and 10, in situ.

An alternate constant pressure texturing device 300 is shown in FIGS. 9 and 10. In this second embodiment, texturing device or apparatus 300 can work in generally the same fashion as the texturing apparatus 10 as previously described. Apparatus 300 can be intended to texture the surface S of end or short structures W. Therefore the travel on texturing device 300 can be limited to short runs or travel paths. For this reason, it lacks a motorized traversing apparatus as in the previously described embodiment, but rather traversing is operated manually.

Texturing apparatus 300 can be suited with a frame 302 that can consist of a bottom 304 attached to upwardly extending sidewalls 306. Each sidewall 306 can be suited with juxtaposed and inwardly facing pairs of flanged rollers 318. The rollers 318 of each roller pair can be spaced vertically apart to receive carriage arms 402 of a slidable texturing carriage assembly 400. The carriage arms 402 can be connected at one end by a spanner tube 404 which can be suited with a split collar 406 that can be apertured to receive a conduit tube 408. Within tube 408 can be a power cord 410 that supplies electrical current to a carriage motor, to be described. The tube 408, at its distal end, can be suited with a T handle 412. T handle 412 is suited with a lever 414 that can be connected to a safety switch (not shown) that can break the electrical circuit if it is released. The power cord 410 can extend from one handle to a power source.

Mounted at a midpoint atop arms 402 can be juxtaposed and spaced apart angle plates 416. Sandwiched between plates 416 can be pairs of vertically spaced apart flanged rollers 418, for example fore and aft, with respect to the surface to be textured. The vertical space between the rollers 418 in each roller pair can be dimensioned to receive a beam 420. At its distal end, away from the surface to be textured, can be an upstanding post 422 which can be apertured to receive a tensing rod 424. As in the first embodiment, a tensioning device can be included. For example, the tensioning device can include a tensioning rod 424 that can be suited with a threaded end engaged by an internally threaded nut 426. A tensioning spring 428 can be telescopically received and axially aligned with the threaded end of the tensioning rod 424, whereby adjustment of the nut 426 in turn can adjust the tension of spring 428 and its pressure exerted upon the post 422. Fixed at a midpoint on plates 416 and sandwiched there between can be a post 430 that can be apertured to receive the end of tensioning rod 424 opposite the threaded end. The rod 424 can be suited with a plurality of bores 432 dimensioned to telescopically receive a pin 434 that can be inserted through the selected bore 432 that allows for proper placement of the texturing tips or pads to the surface to be textured.

Opposite the tensioning spring 428 on slidable beam 420, can be a texturing head 440. The texturing head 440 can consist of a motor 442 to power the texturing tips or pads 444, which is mounted to a motor bracket 446 attached to a pair of angle members 448. The angle members 448 can be mutually connected to an angle member 450 mounted to the proximal end of beam 420. As in the previous embodiment, texturing apparatus 300 can be suited with a tension release lever 452 which can be suited with a bore 454 at its proximal end to receive a pin 456. Pin 456 can be received through the bore 456 and the bore 430 on rod 424 closest the post 430, whereby movement of the distal end of lever 452 can pivot the proximal end of the rod against the surface of the post 430 to in turn move the tension rod 424 rearward to release the tension on the head 440.

In operation, texturing apparatus 300 can be placed on a platform or lift mechanism 800, such as an adjustable table, forklift, or the like. The operator can set up the support platform, adjust the spacing from the surface of the wall to be textured, and set the tension. Afterwards, the carriage can be manually moved along and in engagement with the surface until the desired level of texturing is achieved. As in the first described embodiment, the apparatus can be raised and the process can be repeated until the desired amount of texture has been applied to the surface.

Figure 12A:
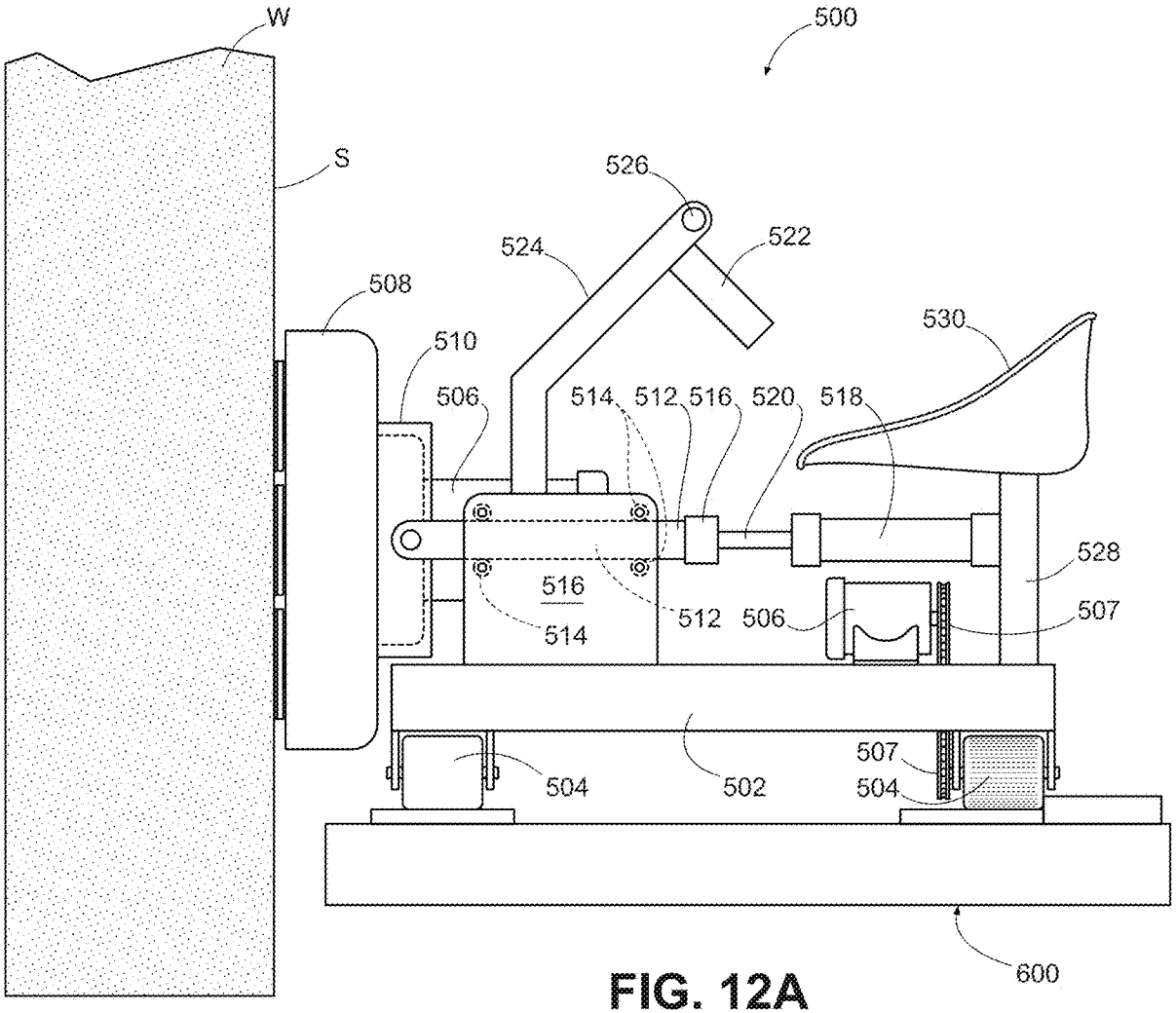
FIG. 12A is a schematized side elevation of a further embodiment of a constant pressure apparatus for applying a texture to a substantially vertical surface.

FIG. 12A schematically depicts another embodiment, a third embodiment, of a constant pressure texturing device 500, which can consist of a base 502 upon which are journaled wheels 504. At least one wheel 504 can be powered by a motor 506 mounted to the base 502. Motor 506 can be driven by chain 507 around sprockets (not shown) and can power at least one wheel 504. Wheels 504 can traverse upon a track 600, such as previously described. The texturing head 508 can be secured by a collar 510, which is connected to a sliding beam 512. The beam 502 can be captured for movement by rollers 514, which are sandwiched between juxtaposed plates 516 attached to the base 502.

The beam 512 can abut a pressure sensor 516, such as a load cell or the like, which can constantly monitor the pressure of the texturing head 508 against the surface S of a structure W being textured. The pressure sensor 516 may send a signal to the abutting pneumatic cylinder 518 to drastically or infinitesimally extend or retract the piston 520 of cylinder 518 relative to undulations in the surface to maintain a constant pressure against the surface with the texturing head 508. Alternately, or in union with the sensing signal governing the cylinder 518, a signal may be sent to a console 522 attached to a column 524, and attached to and extending up from plates 516. Operator handles 526 can extend laterally from column 524. An operator's seat 530 can be positioned on seat post 528.

Figure 12B:
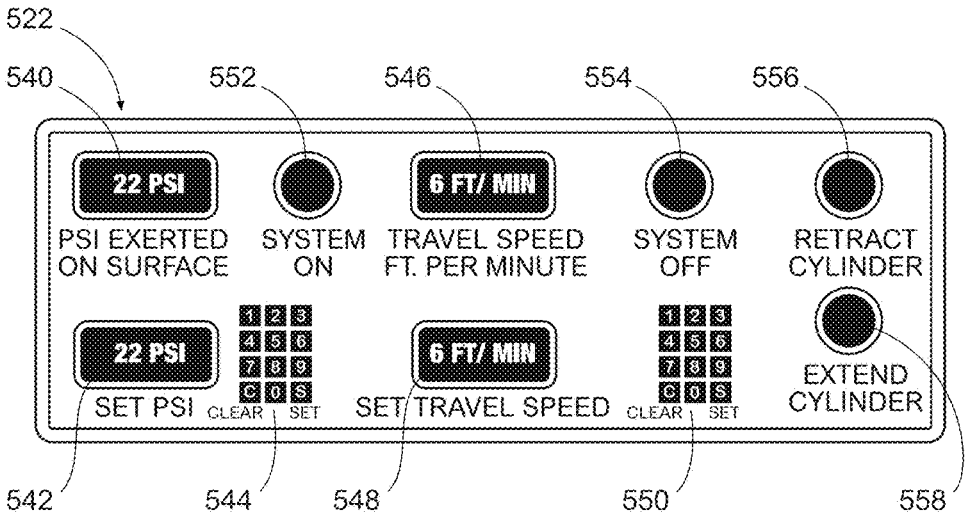
FIG. 12B is a plan view of an instrument console for the alternate embodiment shown in FIG. 12.
Figure 12C:
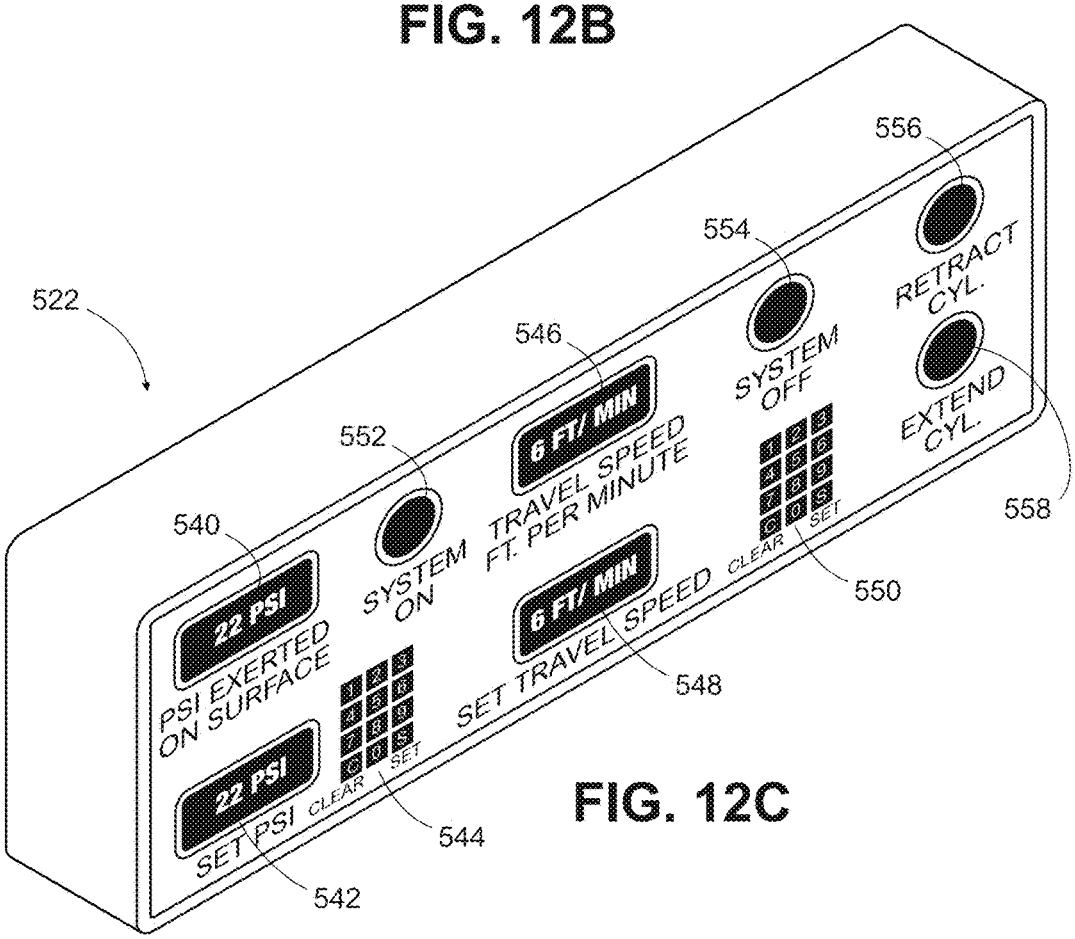
FIG. 12C is an isometric view of the instrument console shown in FIG. 12A.

FIGS. 12B and 12C depict the console 522 shown in FIG. 12. A digital display 540 can show the actual pressure, for example in pounds per square inch, exerted against the surface S of a structure W by the texturing head 508. Below the display 540 can be a display 542 showing the desired pressure to be set. Adjacent the display 542 can be a keypad array 544 having numeral keys along with clear and set keys for clearing the pressure and resetting a new pressure, respectively. Moving to the right, a display 546 can be provided indicating the travel speed of texturing device 500. Below the speed indicator 546 can be a digital display 548 showing the desired speed of travel that can be set on a keypad 550 that can be suited with numeral keys along with clear and set keys. Console 522 can also be suited with a "system on" switch button 552 and a "system off" switch button 554. To the right, on console 522, can be a "retract cylinder" switch button 556 and an "extend cylinder" 558. These switch buttons 556 and 558 can be used to disengage or engage the texturing head 508, respectively from the surface S of the structure W being textured for replacement of worn texturing elements, changing the grit, or the like.

Figure 13:
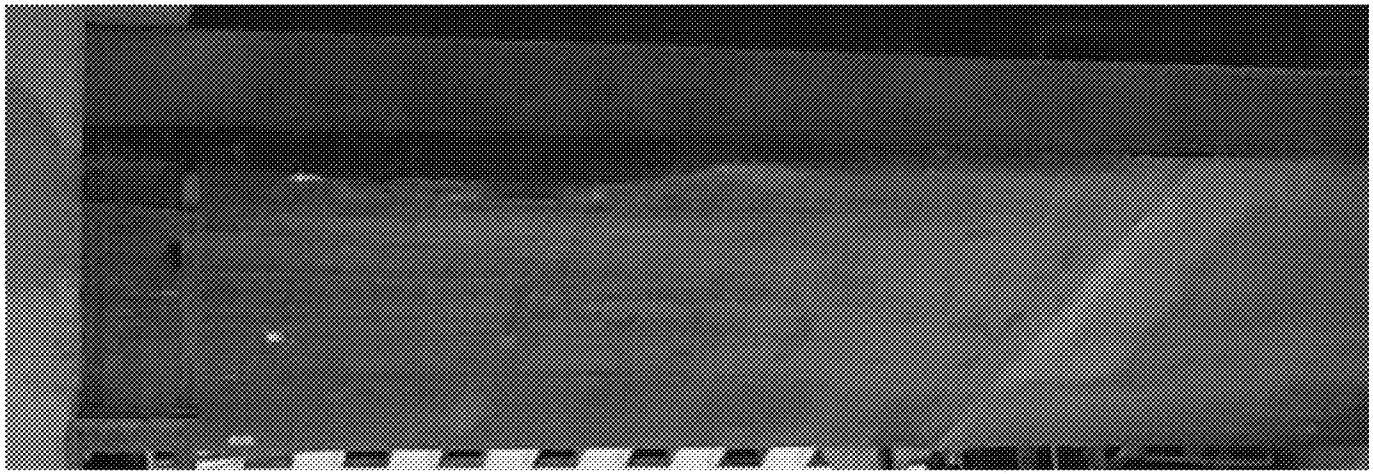
FIG. 13 is a photomicrograph of a vertical surface before application of an even textured surface.
Figure 14:
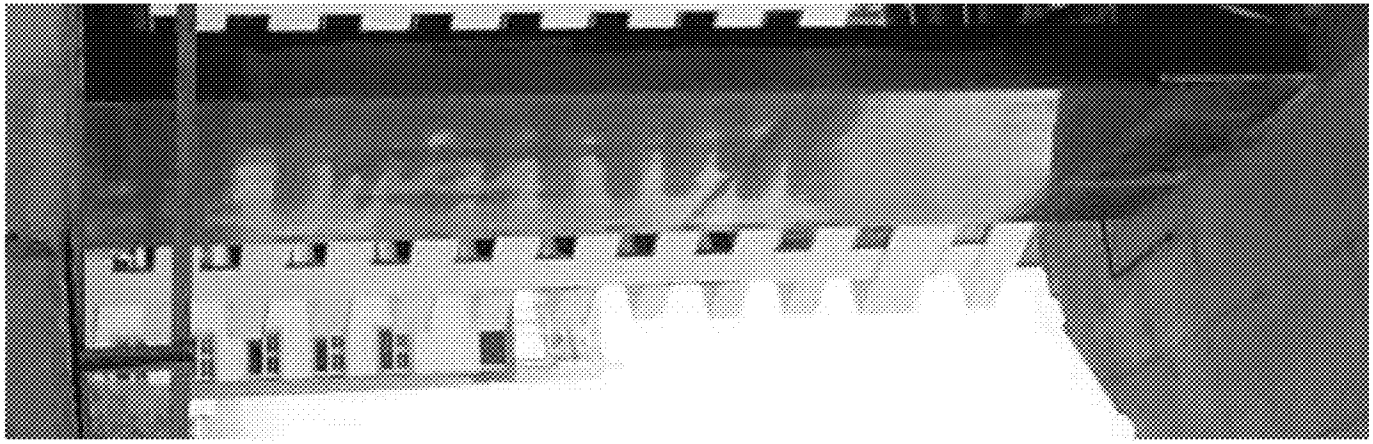
FIG. 14 is a photomicrograph similar to FIG. 13 after texturing and polishing has been applied with the present disclosure.

Referring now to FIGS. 13 and 14, shown is one of numerous potential examples of the result of operating the texturing device against an unfinished working surface. In the exemplary embodiment of FIG. 13, the unfinished working surface can be the exterior surface of a concrete wall. After the image of FIG. 13, the working surface was finished using the texturing device. The resultant finished working surface, illustrated in FIG. 14, shows a smooth reflective surface where the rough concrete wall of FIG. 13 existed. A smooth reflective finish is one of many finishes that the texturing device can create, and is only shown for exemplary purposes.

Figure 15:
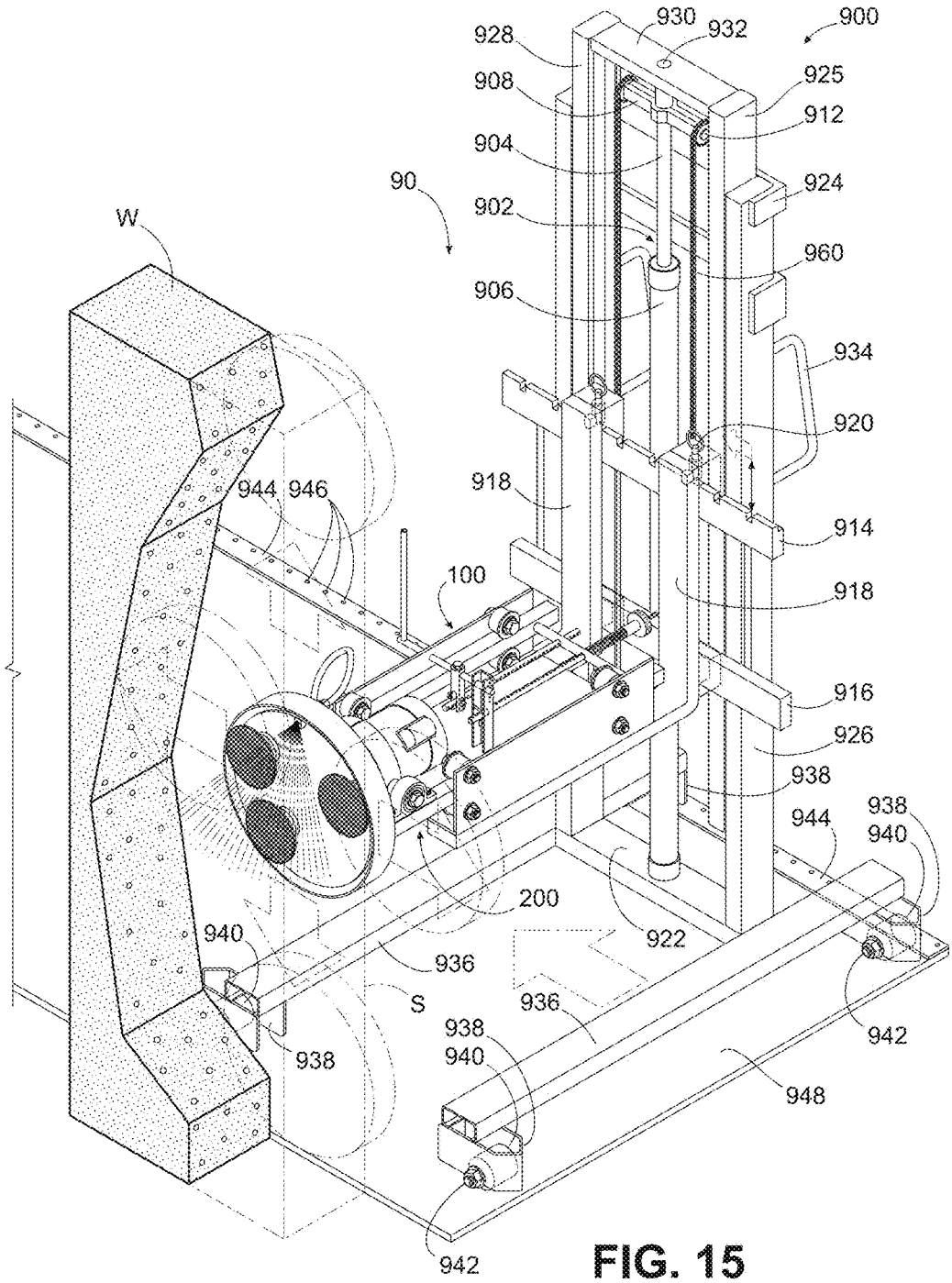
FIG. 15 is an isometric view of the overall constant pressure texturing apparatus suspended from a lift adjacent the surface of a wall to be textured.
Figure 16:
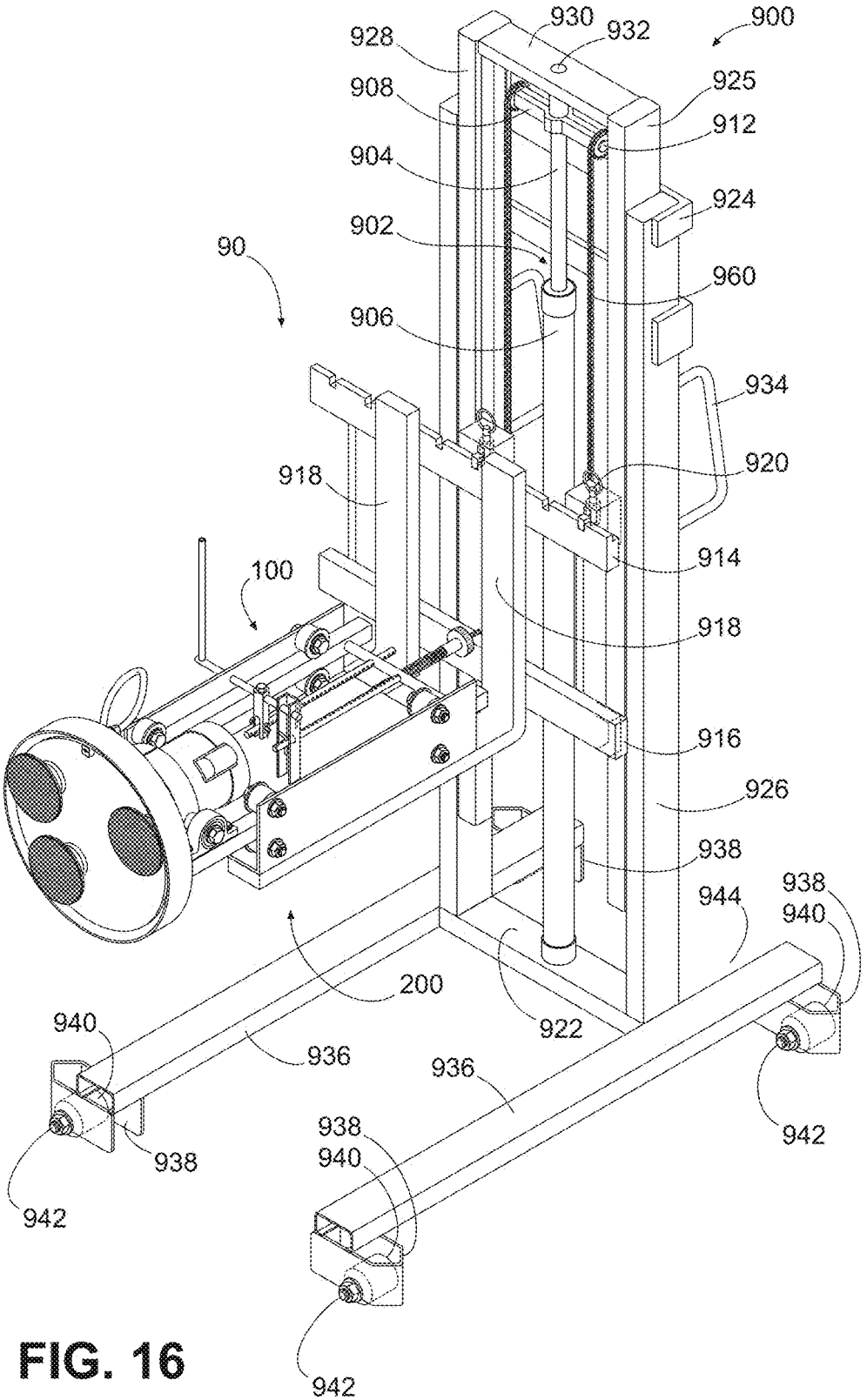
FIG. 16 is an enlarged isometric view of the texturing head on a carriage atop a traversing track adjacent a wall fragment to be textured.

FIGS. 15 and 16 schematically depict another embodiment of the constant pressure texturing device 90. In this fourth embodiment, texturing device 90 can include texturing carriage 100 and texturing slide 200, the descriptions of which are included above at least in connection with FIG. 5. The lift mechanism 900 can comprise a hydraulic lift 902 surrounded by an outer frame comprising a base support 922, upper support 924, and side supports 926. The hydraulic base 906 can be attached at the bottom to base support 922. An inner frame can fit within a track in the outer frame. In some embodiments, the inner frame can comprise extension side support 928 and extension top support 930. The hydraulic lift 902 can comprise a hydraulic piston 904 and hydraulic base 906. In some embodiments, the distal end of the hydraulic piston 904 can be affixed at a piston mount 932 in extension top support 930 and be configured to move the inner frame within the track of the outer frame. In other embodiments, the hydraulic piston can be free from the extension top 930 and move crossbeam 908 between the extension top support 930 and hydraulic base 906 during extension and retraction respectively. In yet other embodiments, the hydraulic piston 904 can be configured to be free from the extension top 930 when moving between a fully retracted position and an intermediate extension position where the hydraulic piston 904 makes contact with the extension top 930 to be in contact with the top extension 930 when moving between the intermediate extension position that initially contacts extension top 930 and a fully extended position. In this embodiment, during extension, the hydraulic piston 904 can move the crossbeam 908 relative to the extension top 930 until making contact, and then moves the inner frame within the track of the outer frame thereafter while crossbeam 908 maintains a relative distance to extension top 930.

The crossbeam 908 can have a chain gear 912 at both ends. A pair of chains 910 can wrap around the pair of chain gears 912. The chains 910 can be mounted to a fork support structure at a first end, the fork support structure being structurally attached proximate to an end opposite the extension top support end of the inner frame and comprising a notched fork support piece 914 and a solid fork support piece 916. The chains 910 can be mounted to the outer frame at a second end or to any immobile structure on the lift mechanism 900. A pair of forks 918 can be mounted on the fork supports 914 and 916. A retaining pin 920 can be inserted in a top part of each of the forks 918 when the forks 918 are aligned with a notch in the notched fork support 914. The retaining pin 920 can be further inserted into the recessed space of one of the notches in the notched fork support 914. Adjustment of the desired width of the fork on the lift mechanism 900 can be accomplished by selecting which notch of the notched fork support 914 to align each of the forks 918 with. The frame 934 also can have a control, such as a pair of handles that can be used to move the texturing device 90. Base support 922 can have base feet 936 attached perpendicularly at both sides to provide lateral support. When the texturing device 90 is positioned in front of a working surface, the base feet 936 can be substantially perpendicular to the work surface in order to provide support when the texturing device 90 applies pressure against the working surface. At their distal ends, the base feet 936 can be suited with roller assemblies. These roller assemblies can consist of downwardly projecting wheel mounting plates 938 with wheels 940 journaled for rotation by axles 942. Fixed atop the back track of decking 948, away from structure W, can be a biasing bar 944. The biasing bar 944 can be suited with a plurality of apertures 946 that receive screws (not shown) for adjustably securing the bar to the decking 948 at the rear wheel 940. In operation, biasing bar 944 can be in constant contact with a lower portion of the sidewall of rear (away from the wall) wheels 940. Contact with the biasing bar 944 by wheels 940 can maintain a fixed spatial relationship between the wall W and the texturing carriage 100.

In further embodiments, the present disclosure provides a texturing head that can be used as a curved surface polisher. The curved surface can be a concave surface or a convex surface. The convex surface can be a column or a similar structure. In some aspects, the texturing head can also be used on flat work surfaces. In some aspects, the texturing head can be used with an apparatus for applying a uniform texture to a substantially vertical work surface, such as described above.

Figure 17:
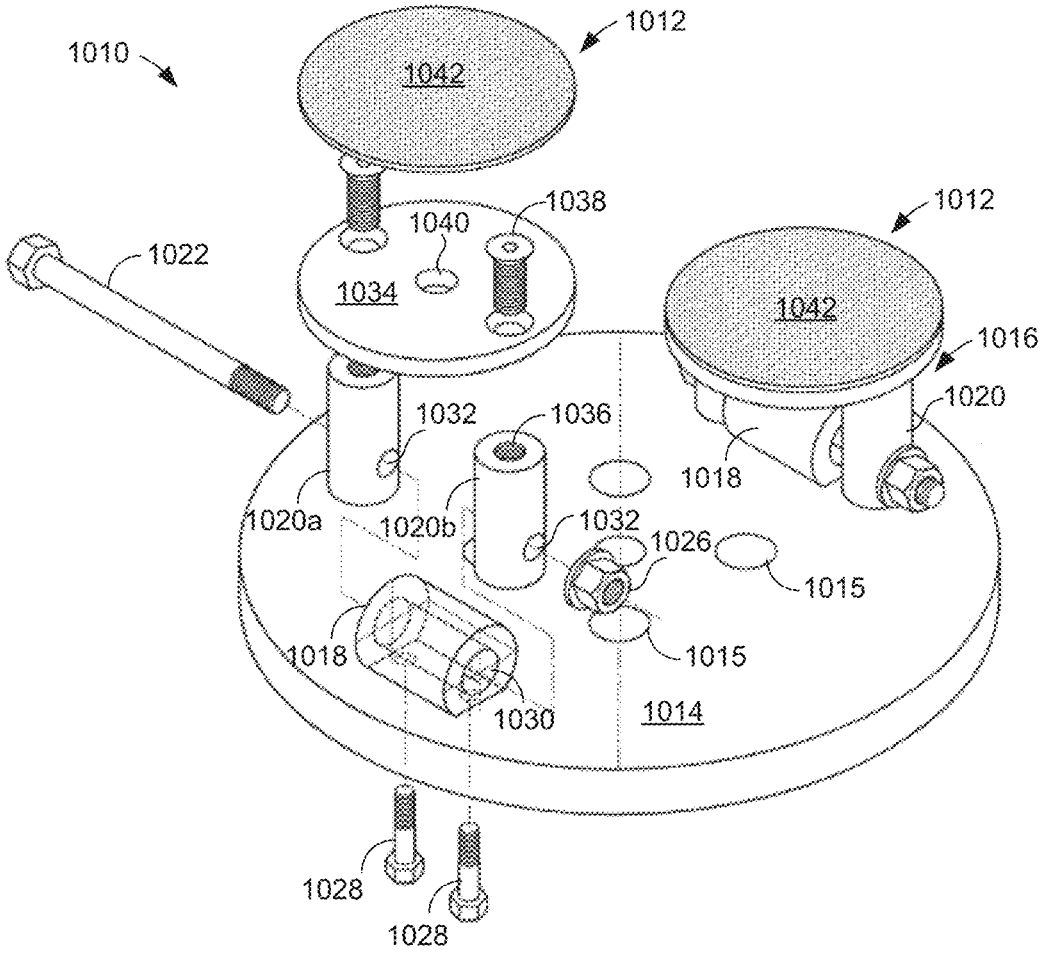
FIG. 17 is a partially exploded isometric view of a texturing head according to an example embodiment described herein.

FIG. 17 illustrates an example of a texturing head that can be used as a texturing device for curved work surfaces. In various aspects, the texturing head 1010 includes one or more texturing bits 1012 including finishing pads 1042 mounted on a base plate 1014. In the particular embodiment of FIG. 17, two texturing bits 1016 are depicted, one in assembled form and one in an exploded view. In some aspects, the base plate 1014 can have a plurality of apertures 1015. In some aspects, each texturing bit 1012 can be mounted using a pivot device 1016 comprising a pivot block 1018, one or more pivot members 1020, for example pivot members 1020*a* and 1020*b*, pivot shaft 1022, washer 1024, and locking member 1026. In some embodiments, a pivot block 1018 can be secured to the base plate 1014 using one or more mounting bolts 1028 or other similar fastener. In some aspects, the pivot block 1018 can be a substantially cylindrical with a flat surface parallel to the axis of symmetry to mount flush with the base plate 1014 and a shaft aperture 1030 about the axis of symmetry to receive a pivot shaft 1022 to mount the pivot members 1020. In some aspects, the pivot shaft 1022 can have a head on one end and a securing portion on the other end to receive a locking member 1026. In some aspects, the pivot shaft 1022 can be a bolt with threaded end to receive a nut. The pivot device 1016 can also have a pair of pivot members 1020*a*, 1020*b* with a pivot member hole 1032 to receive a pivot shaft 1022 to allow the bit(s) to pivot about pivot block 1018 and a means to attach a bit plate 1034 at the distal end(s) of the pivot member(s). In some aspects, each pivot member 1020 can be substantially cylindrical with a seat 1036 to receive a bit plate connector 1038. In some aspects, the seat 1036 can be an aperture with a threaded interior to receive a connecting bolt, such as a hex drive connecting bolt. In other aspects, the seat 1036 can be sized to receive a pin, screw, rod, spring loaded connector, or other similar fastener. In some embodiments, each bit plate 1034 is secured to one or more pivot members 1020 (such as a pair of pivot members 1020*a*, 1020*b*) of a pivot device 1016. In some aspects, the texturing bit 1012 includes a bit plate 1034 with at least one bit plate aperture 1040 and a finishing or texturing pad 1042 secured to the bit plate 1034. In some embodiments, the aperture(s) 1040 on the bit plate 1034 may be beveled to allow a connector to be countersunk or allow a flush connection. The at least one finishing pad 1042 can be at a polishing pad, a buffing pad, a sanding pad, and/or a texturing pad for providing a desired texture to the work surface.

In the example shown in FIG. 17, the securing portion of the pivot shaft 1022 is inserted through a first pivot member 1020*a*, then through the pivot block 1018, then a second pivot member 1020*b*, and secured by a locking mechanism, such as a washer 1024 and locking member 1026. In some aspects, the texturing bit 1012 is secured to the pair of pivot members 1020*a*, 1020*b* and can rotate about the pivot shaft 1022 or to the position the texturing bit 1012 can contact the base plate 1014. In some aspects, the shaft aperture 1030 has a diameter larger than the diameter of the pivot shaft 1022 to allow the pivot shaft 1022 to tilt allowing additional movement of the attached texturing bit 1012.

Figure 18:
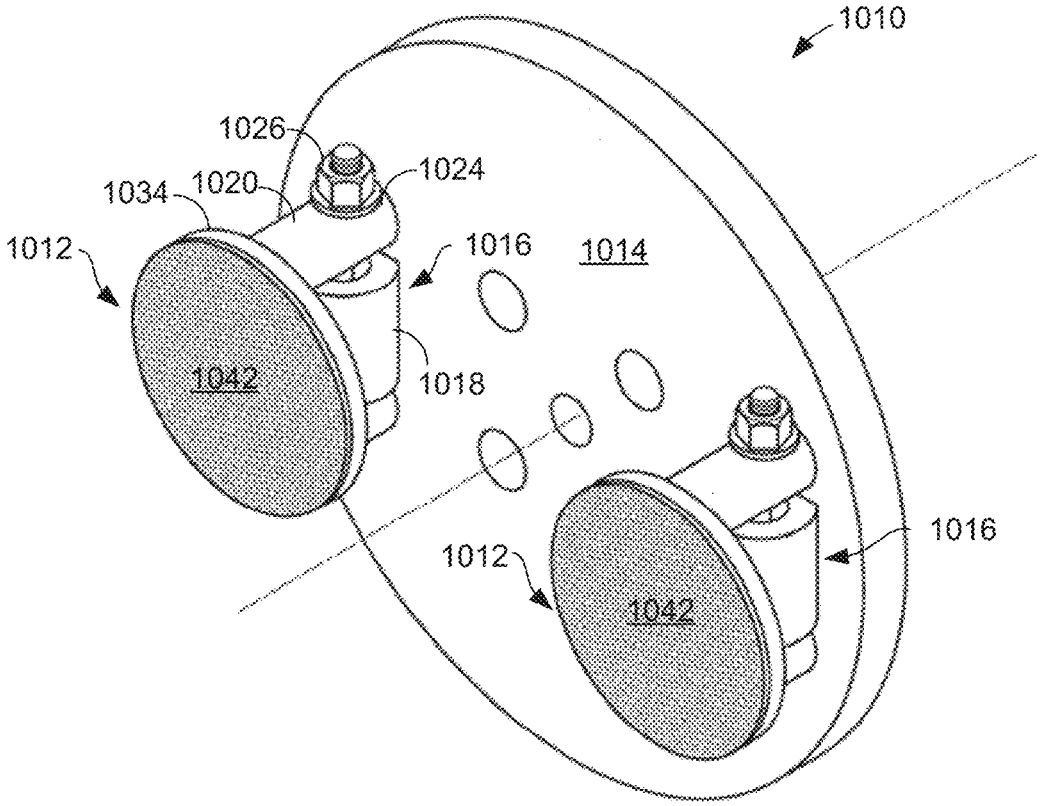
FIG. 18 is an isometric view of a texturing head in an example embodiment with 2 bit texturing pads.
Figure 19:
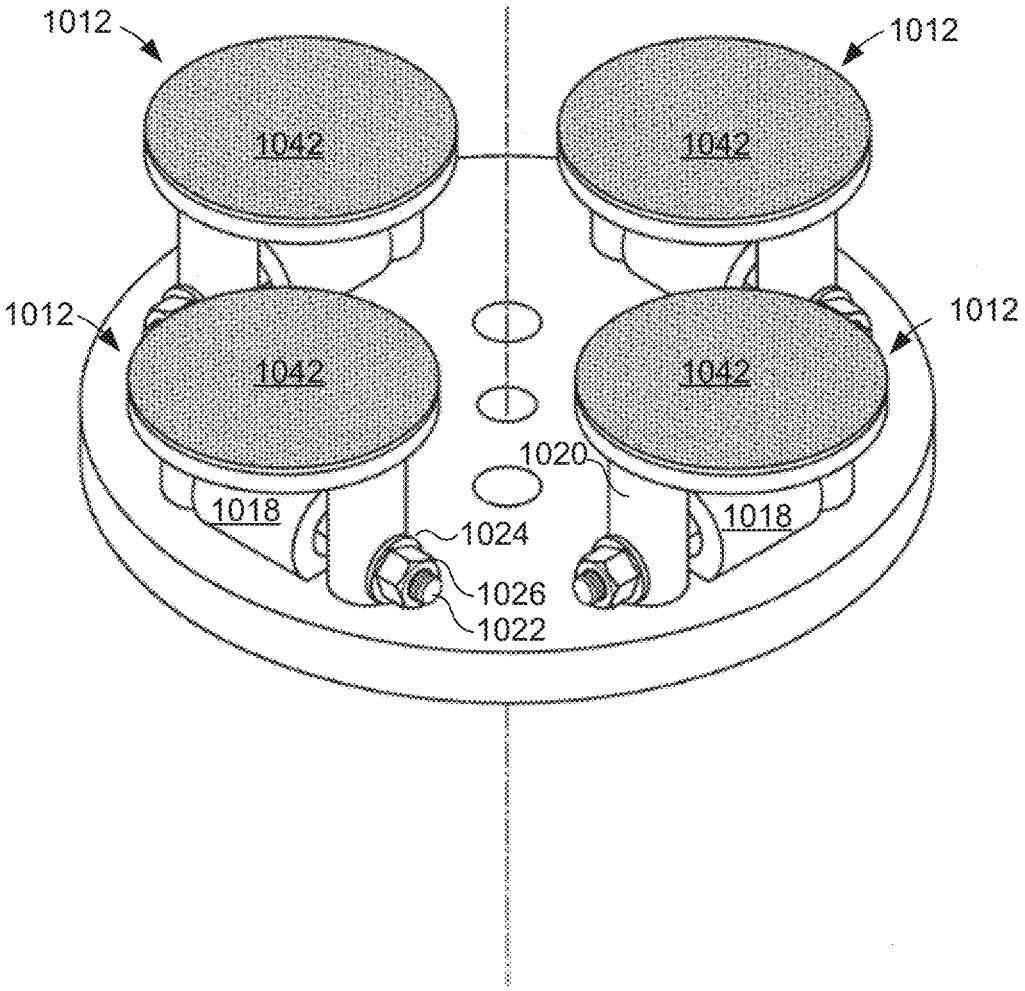
FIG. 19 is an isometric view of a texturing head in an alternate embodiment with 4 bit texturing pads.

Next, FIG. 18 illustrates an assembled texturing head 1010 with two texturing bits 1012. One skilled in the art will recognize that the number and size of the texturing bits 1012 may be adjusted. For example, FIG. 19 illustrates an assembled texturing head 1010 with four texturing bits 1012. Additionally, while the figures show an even number of bits, symmetrically distributed, an odd number can be used or positioned in various patterns. The texturing head 1010 can be secured to a motor, such as motor 214, configured to move the finishing pads 1042 across a work surface. Additionally, a mechanism such as described above, can be provided to apply a constant pressure of the texturing head 1010 and in particular the finishing pad(s) 1042 against a work surface.

Figure 20A:
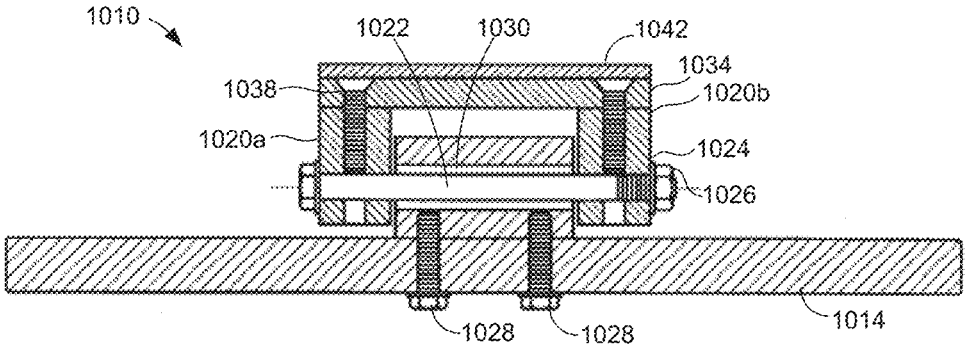
FIGS. 20A and 20B are cross-sectional views along the axis of a pivot shaft of an embodiment of a texturing head, in a ready position (FIG. 20A) and in contact with a concave surface (FIG. 20B).

Turning now to FIG. 20A, an example of the texturing head 1010 is shown in planar cross-section at the pivot shaft 1022 in a ready or disengaged position. The structure of the pivot device 1016 assembly is shown. The pivot block 1018 can be secured to the base plate 1014 with two bolts 1028. Each of the pivot members 1020 can be secured to the bit plate 1034 with counter sunk means of coupling to allow a flush surface to secure the texturing pad 1042. The pivot shaft 1022 is used to complete assembly. The length of the pivot shaft 1022 is sufficient to extend through the pivot block 1018, pair of pivot members 1020, and attach to locking member 1026. In some aspects, the pivot shaft 1022 may have a head at one end and a threaded section at the opposite end to receive a locking means. The pivot shaft 1022 can have a clearance within the shaft aperture 1030 of the pivot block 1018. In some aspects, the pivot device 1016 constrains the pivot shaft 1022 allowing side to side movement about the pivot block 1018, while the additional clearance around the pivot shaft 1022 allows additional degrees of freedom to adjust to a non-planar work surface.

Figure 20B:
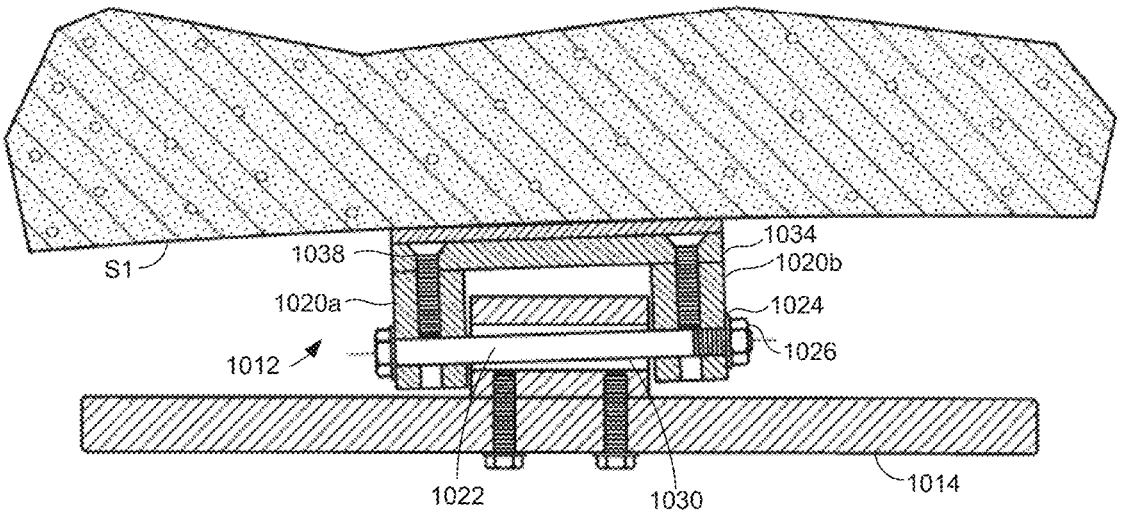

The cross-sectional view in FIG. 20B illustrates the same embodiment of the texturing head, but now engaged with a concave surface S1. The texturing bit 1012 can be tilted to adjust for the contour of the surface S1, while remaining in full contact. In some aspects, the texturing bits 1012 are secured by the pivot device 1016, yet allowing some free movement to apply full pressure to the curved work surface.

Figure 21A:
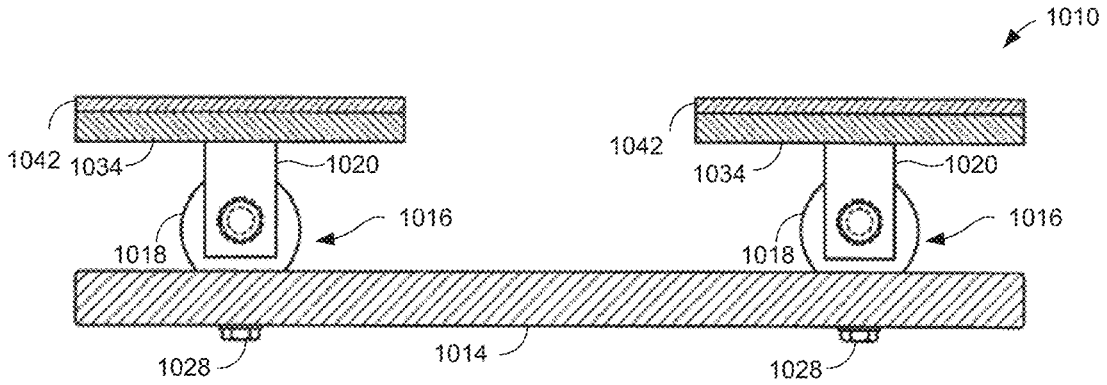
FIGS. 21A and 21B are cross-sectional views at the side of two texturing bits of a texturing head, in a ready position (FIG. 21A) and in contact with a concave surface (FIG. 21B), according to an embodiment.
Figure 21B:
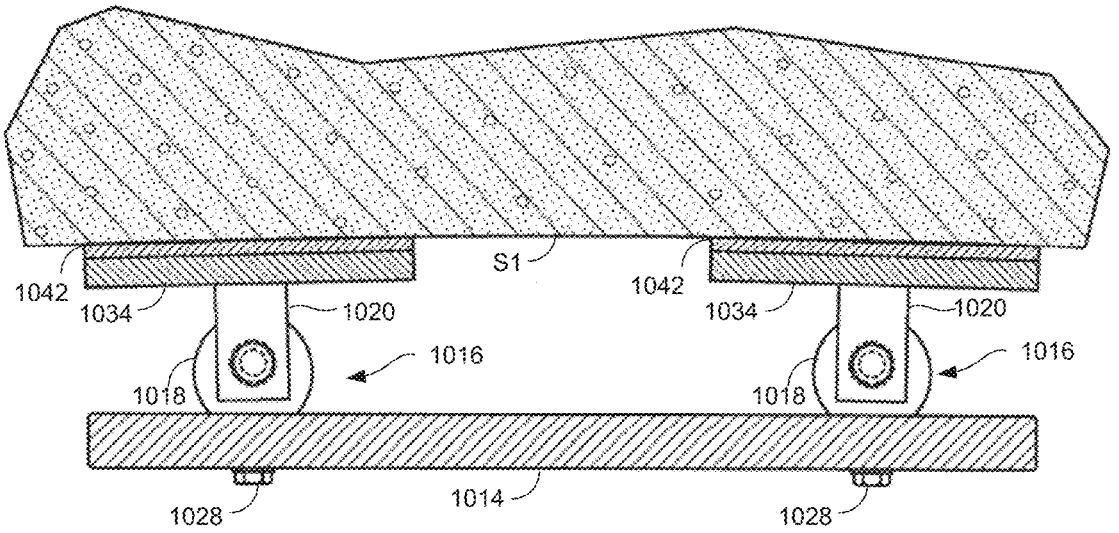

Next, FIG. 21A illustrates an alternate cross-sectional view of a texturing head 1010 including pivot devices 1016. An embodiment with two texturing bits 1012 is shown in a ready or disengaged position, representing a side view of the texturing head 1010. In a cross-section view, two texturing bits 1012 are illustrated with the texturing pads 1042 shown generally parallel to the base plate 1014. In FIG. 21B, the cross-section view illustrates a texturing head 1010 with two texturing bits 1012 engaged with a concave surface S1 with the texturing bits 1012 allowed to pivot about the pivot shaft 1022 to conform to the curved or contoured work surface. In some aspects, the texturing bits 1012 can tilt in opposite directions to conform to the contoured work surface.

Figure 22A:
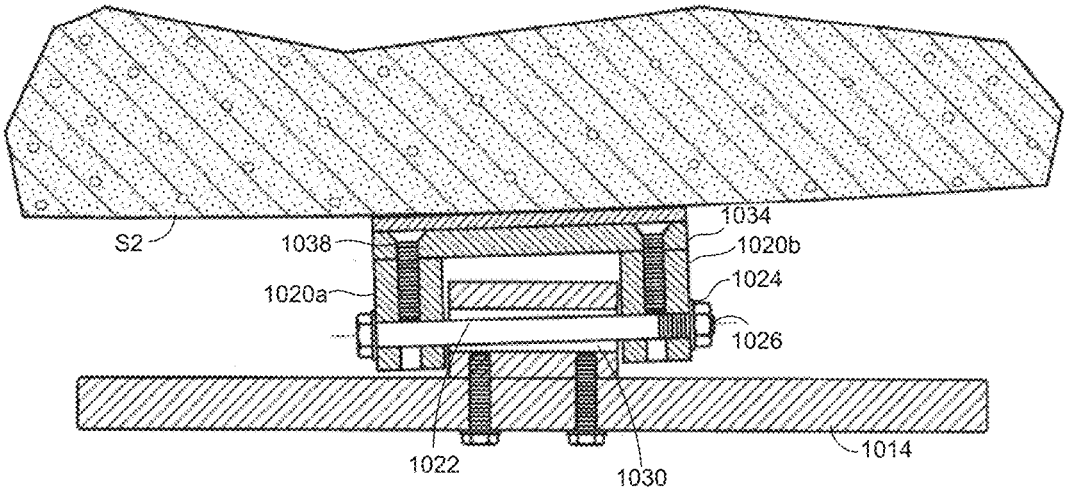
FIGS. 22A and 22B are cross-sectional views of along the axis of a pivot shaft (FIG. 22A) and at the side of two texturing bits (FIG. 22B) of an embodiment of a texturing head, in contact with a convex surface.
Figure 22B:
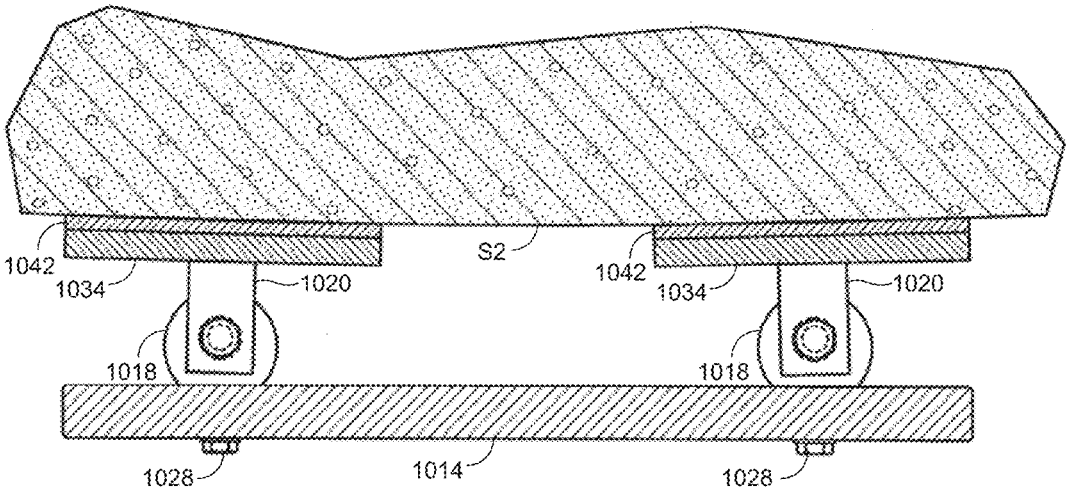

Similarly, FIGS. 22A and 22B illustrate cross-sectional views of a texturing head 1010 engaged with a convex surface S2. The cross-sectional view in FIG. 22A illustrates the same embodiment of the texturing head, but now engaged with a convex surface S2. The texturing bit 1012 can tilt to adjust to the contour of the surface S2, while remaining in full contact. In some aspects, the texturing bits 1012 are secured by the pivot device 1016, yet allowing some free movement to apply full pressure to the curved surface. In FIG. 22B, the cross-section view illustrates a texturing head 1010 with two texturing bits 1012 engaged with a convex surface S2 with the texturing bits 1012 allowed to pivot about the pivot shaft 1022 and conform to the convex or contoured work surface. In some aspects, the texturing bits 1012 can tilt in inward to conform to the contoured work surface.

Figure 23:
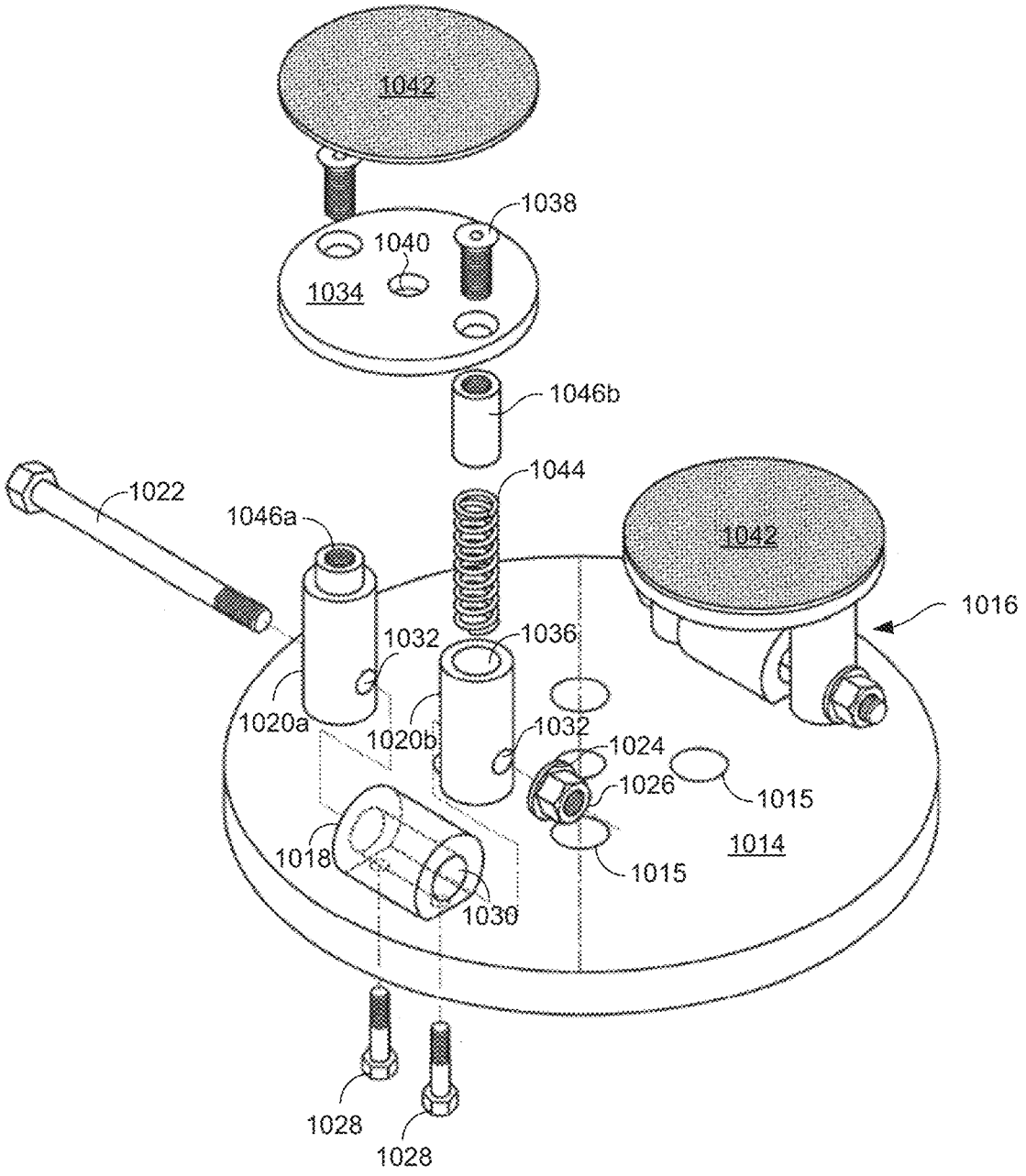
FIG. 23 is a partially exploded isometric view of a spring loaded texturing head according to an exemplary embodiment.
Figure 24:
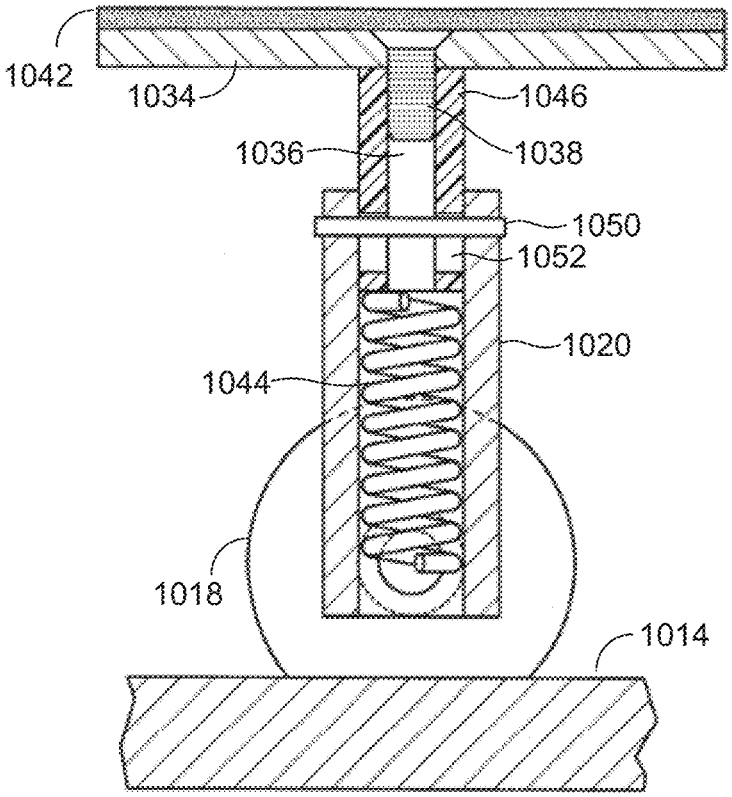
FIG. 24 is an example of a cross-sectional view of a spring loaded texturing bit according to various embodiments.

An alternate embodiment of a texturing head 1010 is shown in FIG. 23 in a partially exploded view depicting one pivot device 1016 in assembled form and one pivot device 1016 in an exploded view. In this embodiment, each pivot member 1020 has a seat 1036 with a diameter to receive a spring 1044 and spacer 1046. In some aspects, the spacer 1046 can be cylindrical with a through spacer aperture 1048 sized to receive a bit plate connector 1038. Additionally, FIG. 24 illustrates cross-section view through a pivot member 1020 of a texturing bit 1012 with a spring 1044 and spacer 1046 configuration. The spacer 1046 can be configured to be slidably received within its respective seat 1056 such that spacer 1046 can extend outwardly or be retracted within seat 1036. At least a portion of the spacer 1046 can be secured within seat 1056 for reciprocal movement into and away from seat 1056. In some embodiments, for example, spacer 1046 can have an opening 1052 through which a stopper 1050 can be received. The opening 1052 can be sized to allow for a given amount of inward and outward sliding movement of spacer 1046 within seat 1036.

Figure 25A:
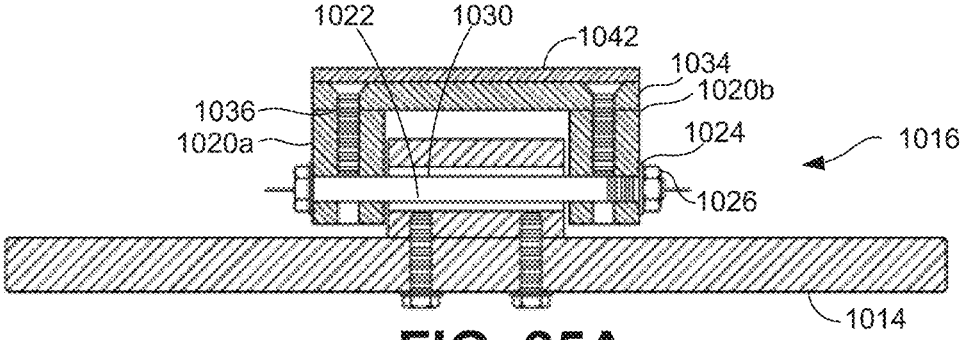
FIGS. 25A and 25B are cross-sectional views along the axis of a pivot shaft of an embodiment of a texturing head, in a ready position (FIG. 25A) and tilted position (FIG. 25B) to adjust to surface according to various embodiments.

Turning now to FIG. 25A, an example of the texturing head 1010 is shown in planar cross-section at the pivot shaft 1022 in a ready or disengaged position. The structure of the pivot device 1016 assembly is shown. The pivot block 1018 can be secured to the base plate 1014 with two bolts 1028. Each of the pivot members 1020 can be secured to the bit plate 1034 with counter sunk means of coupling to allow a flush surface to secure the texturing pad 1042. In some aspects, the means of coupling include a spring 1044 (not shown). The pivot shaft 1022 is used to complete assembly. The length of the pivot shaft 1022 is sufficient to extend through the pivot block 1018, pair of pivot members 1020, and attach to locking member 1026. In some aspects, the pivot shaft 1022 may have a head at one end and a threaded section at the opposite end to receive a locking means. The pivot shaft 1022 can have a clearance within the shaft aperture 1030 of the pivot block 1018. In some aspects, the pivot device 1016 constrains the pivot shaft 1022 allowing side to side movement about the pivot block 1018, while the additional clearance around the pivot shaft 1022 allows additional degrees of freedom to adjust to a non-planar surface.

Figure 25B:
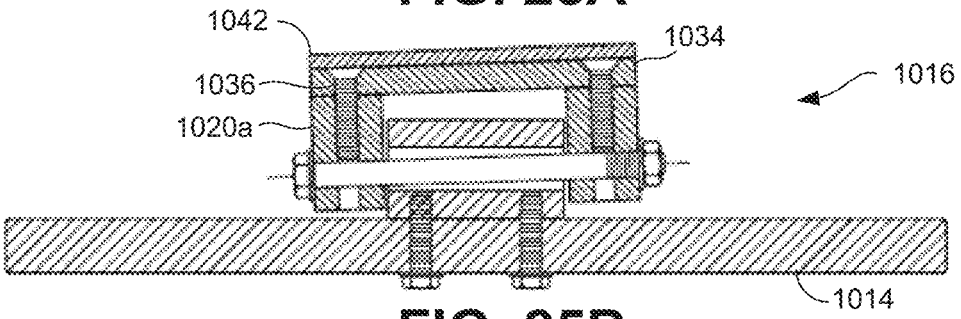

The cross-sectional view in FIG. 25B illustrates the same embodiment of the texturing head, but shown with texturing bit 1012 tilted to adjust for the contour of a surface. In some aspects, the texturing bits 1012 are secured by the pivot device 1016, yet allowing some free movement to apply full pressure to the curved surface.

Figure 26A:
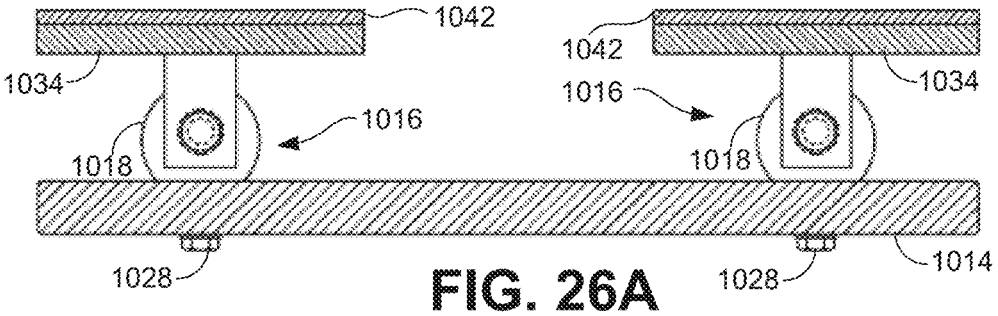
FIGS. 26A and 26B are cross-sectional views at the side of two texturing bits a texturing head, in a ready position (FIG. 26A) and with tilt adjustment (FIG. 26B), according to an embodiment.
Figure 26B:
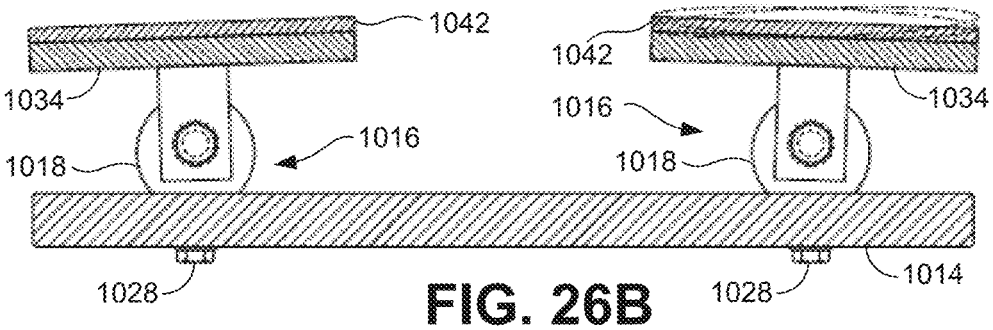

FIGS. 26A and 26B are cross-sectional side views of two texturing bits of a texturing head 1010 near pivot devices 1016. An embodiment with two texturing bits 1012 is shown in a ready or disengaged position in FIG. 26A, representing a side view of the texturing head 1010. In a cross-section view, two texturing bits 1012 are illustrated with the texturing pads 1042 shown generally parallel to the base plate 1014. In FIG. 26B, the cross-section view illustrates a texturing head 1010 with two texturing bits 1012 tilted to adjust for the contour of a work surface with the texturing bits 1012 allowed to pivot about the pivot shafts 1022. In some aspects, the texturing bits 1012 can tilt in opposite directions to conform to the contoured surface. In some aspects, when spring 1044 (not shown) is employed as in FIG. 23, the finishing pad 1042 can move to adjust to the surface and maintain constant pressure against the work surface.

Figure 27:
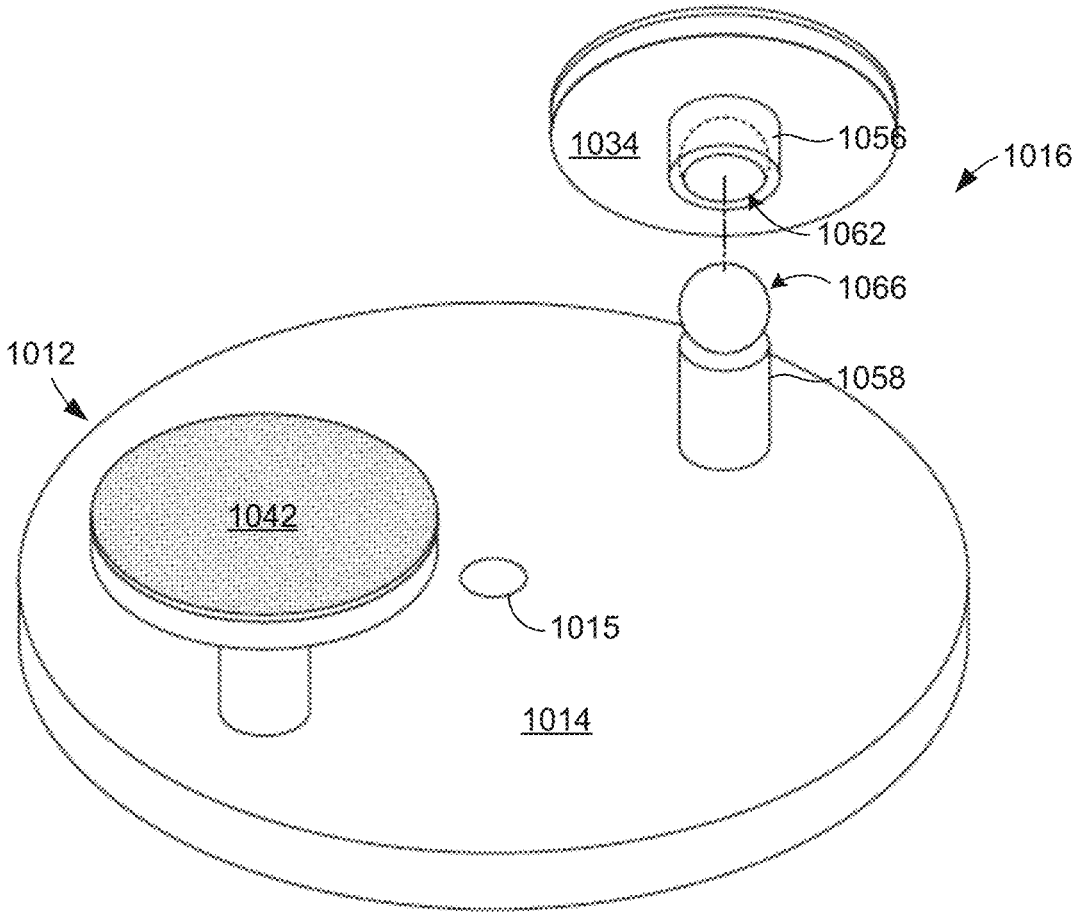
FIG. 27 is a partially exploded isometric view of finishing pads mounted on ball and socket joint texturing bits of a texturing head according to an exemplary embodiment.

Turning now to FIG. 27, an alternate embodiment of a pivoting device 1016 of a texturing head 1010 is shown with finishing pads 1042 mounted on two texturing bits 1012. The texturing bits 1012 comprise bit plate 1034 attached to socket 1056, which can be coupled with ball post 1058. In some aspects, the socket 1056 can be separate from the bit plate 1034. In some aspects, the socket 1056 can be made in one piece with a bit plate 1054. The socket 1056 can be cylindrically shaped with a flat portion 1060 attached to bit plate 1034 and a bowl shaped portion 1062 of the socket 1056 configured to receive ball post 1058. In some aspects, the bowl shaped cavity portion 1062 can be semi-hemispherical. The ball post 1058 can be generally cylindrical with a flat portion 1064 used to flush mount to base plate 1014 and a ball shaped surface 1066 configured to couplingly mate with socket 1056. In some aspects, the ball post 1058 can include a seat 1068 to receive connecting means for flush mounting with base plate 1014. In some aspects, the seat 1068 can be an aperture with a threaded interior to receive a connecting bolt, such as a hex drive connecting bolt. In other aspects, the seat 1068 can be sized to receive a pin, screw, rod, spring loaded connector, or other similar fastener.

Figure 28:
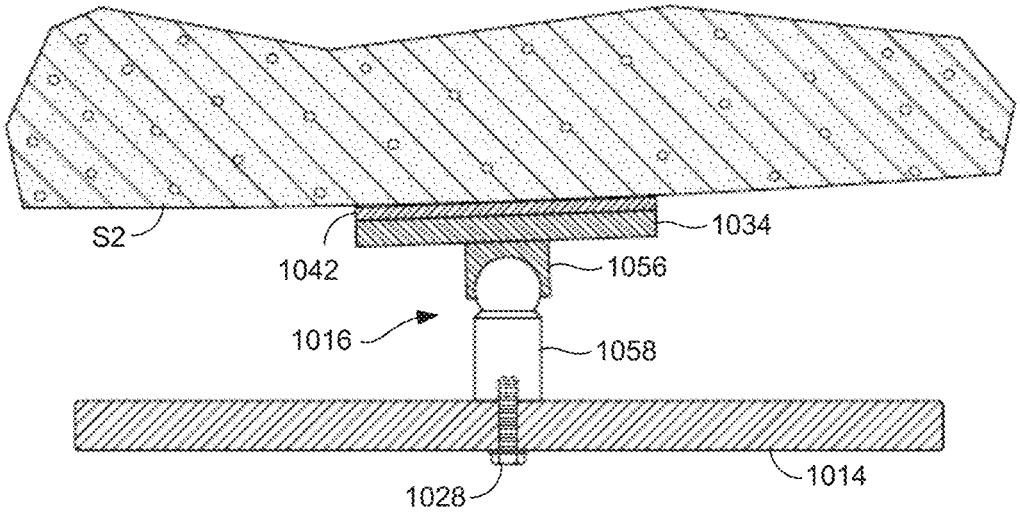
FIG. 28 is an example of a cross-sectional view of a ball and socket mounted texturing bit engaged with a convex surface, according to various embodiments.

Shown in FIG. 28 is an example of a cross-sectional view of a pivot device 1016 including a ball post 1058 and socket 1056 mounted texturing bit 1034 engaged with a convex surface S2. The ball post and socket configuration allows freedom of movement in all directions to conform with a work surface and apply pressure of the at least one finishing pad against the work surface.

Figure 29:
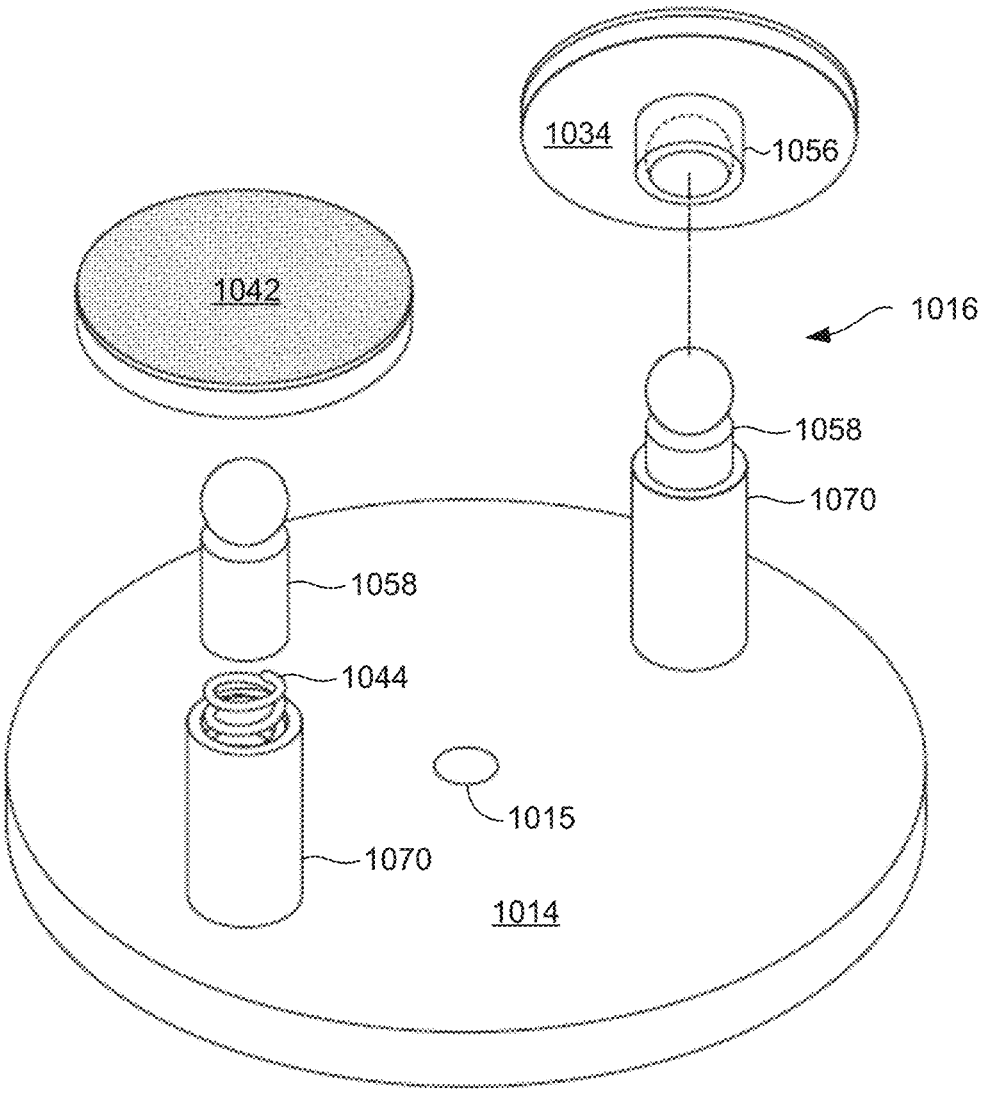
FIG. 29 is a partially exploded isometric view of finishing pads mounted on spring loaded ball and socket joint texturing bits of a texturing head according to an exemplary embodiment.

Next, FIG. 29 shown is an alternate embodiment of finishing pads 1042 mounted to a pivot device 1016 including a spring loaded 1044 ball post 1058 and socket 1056 joint texturing bits 1012 of a texturing head 1010. In this example, a seat member 1070 can be configured to receive a spring 1044 and a ball post 1058. The ball post 1058 can be secured to the seat member 1070 to allow movement of the ball post 1058 into and away from seat member 1070. The seat member 1070 can be cylindrical in shape with a hollow bore 1072 configured to receive the ball post 1058 allowing the ball post to slide freely within the seat member 1070 such that ball post 1058 can extend from or be retracted within seat number 1070.

Figure 30:
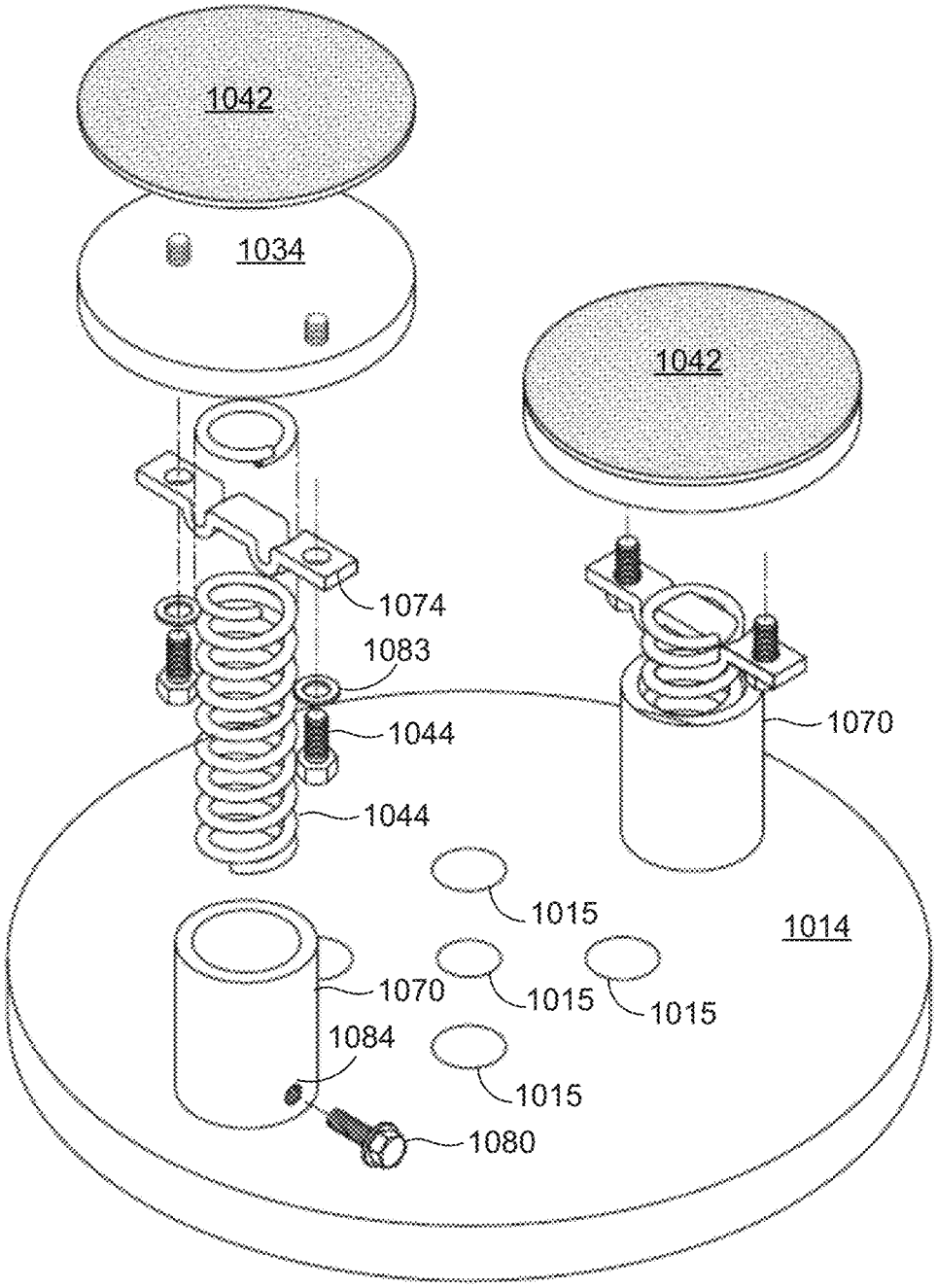
FIG. 30 is a partially exploded isometric view of a spring attached texturing bit according to an example embodiment described herein.
Figure 31:
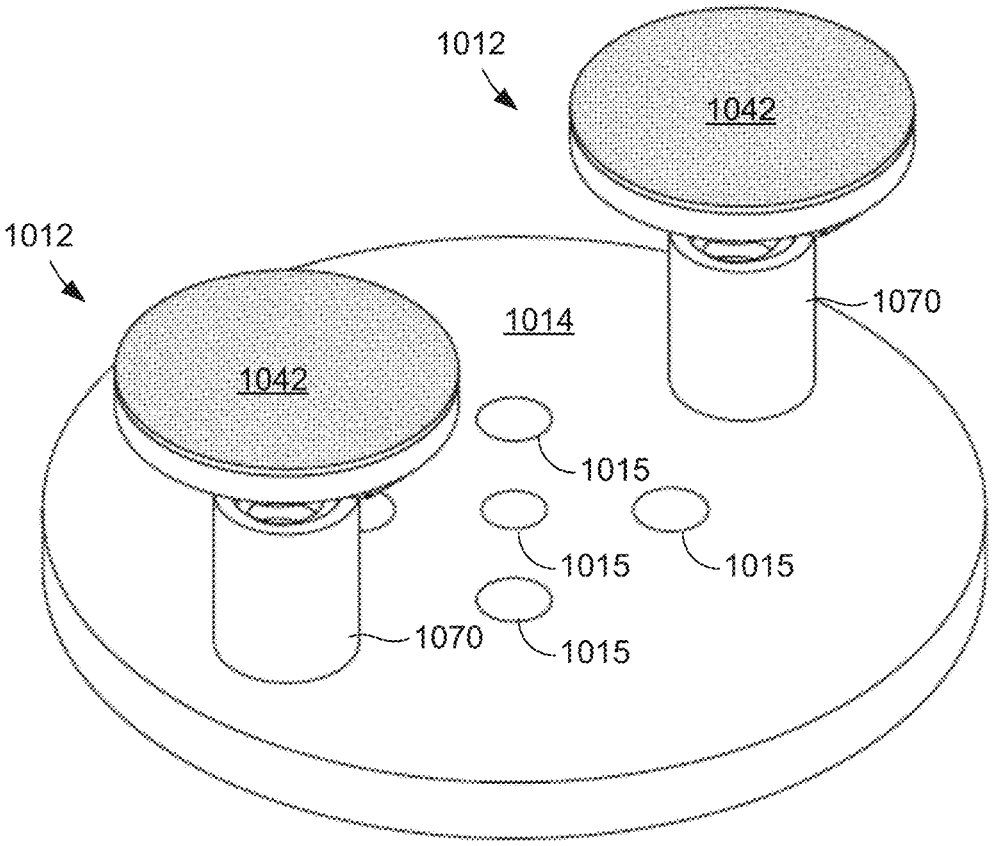
FIG. 31 is an isometric view of a spring attached texturing bit in an example embodiment.
Figure 32:
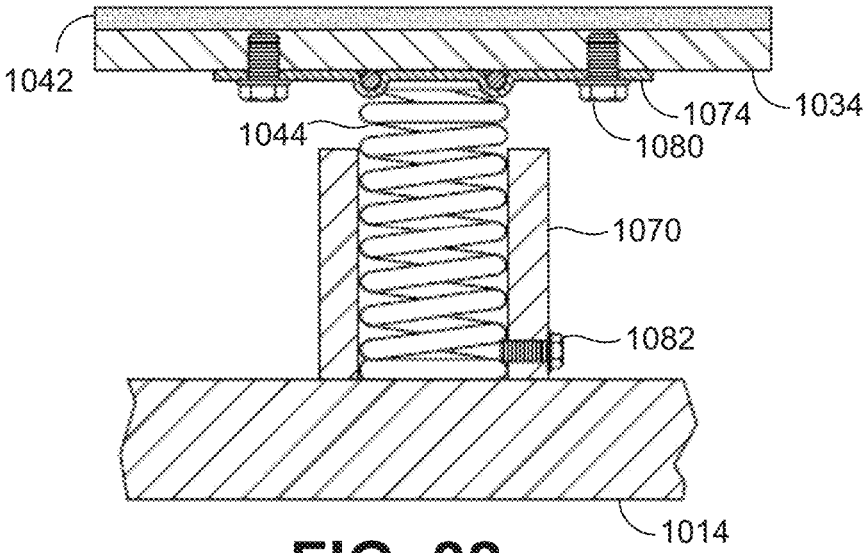
FIG. 32 is an example of a cross-sectional view of a spring attached texturing bit according to various embodiments.

Turning now to FIGS. 30 through 32, an alternate embodiment of a texturing head 1010 for engaging a curved or contoured work surface including spring attached texturing bits 1012 to mount finishing pads 1042. In this embodiment, a texturing bit 1012 can comprise a seat member 1070 configured to receive a spring 1044, with the spring coupled to the bit plate 1034 using a securing member 1074. The securing member 1074 can be a substantially plate-like member with indentations formed and spaced to secure an end of a spring 1044 to the bit plate. The securing member 1074 can also have one or more apertures 1076 to insert a connector 1080, such as a bolt or screw, through the securing member and into the bit plate 1034. In some aspects, a washer 1083 can be used between the connector 1080 and the securing member 1074, inserting the end of the connector 1080 into an aperture 1040 in the bit plate 1034, to secure the spring to the bit plate 1034. In some aspects, the connector 1080 and the aperture 1040 can be threaded. The seat member 1070 can be secured to the base plate 1014. In some aspects, the seat member 1070 can have a bore 1082 through the side near one end to allow insertion of a connector 1080 through the bore 1082 to secure the spring 1044 to the base plate 1014. The height of the seat member 1070 can be less than the length of the spring 1044 to allow clearance between the bottom of the bit plate 1034 and the top of the seat member 1070. In some aspects, a texturing bit 1034 secured to a spring 1044 with clearance between the bit plate 1034 and seat member 1070 allows the finishing pad 1042 to conform to the work surface with the spring 1044 applying pressure.

Figure 33:
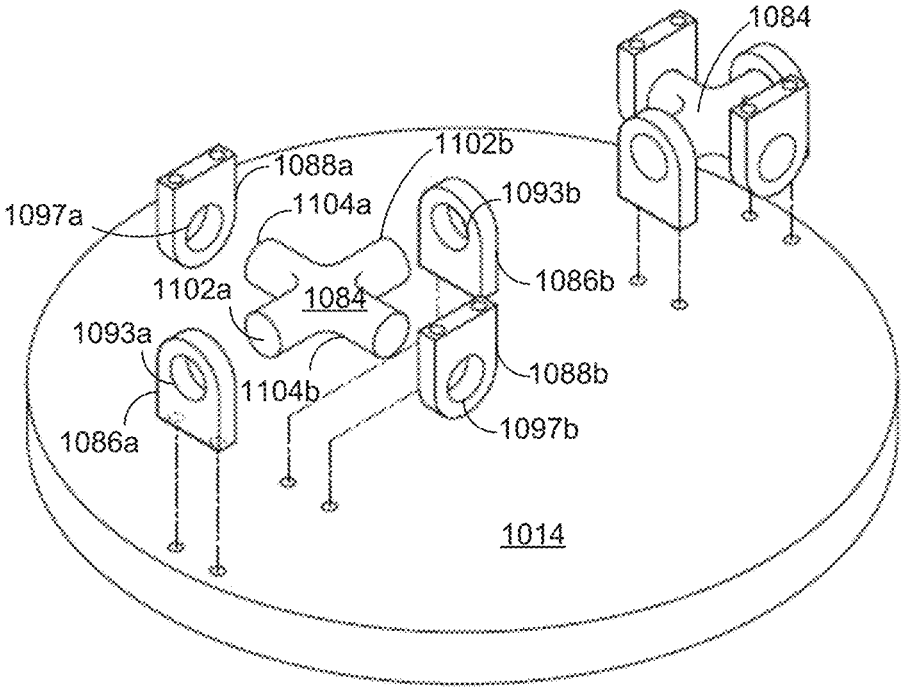
FIG. 33 is a partially exploded isometric view of a spring attached texturing bit according to an example embodiment described herein.
Figure 34:
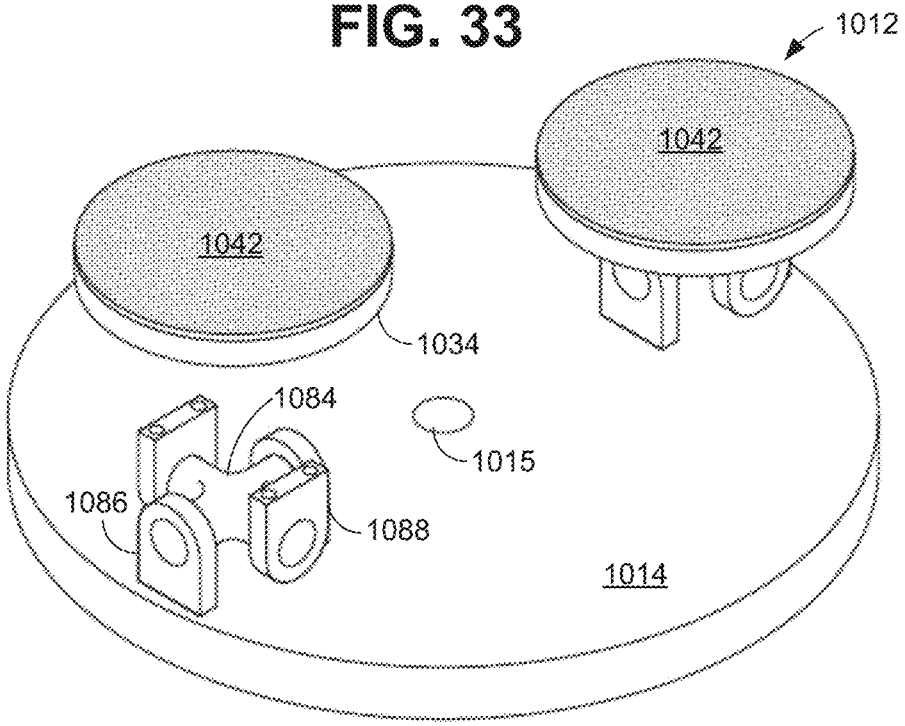
FIG. 34 is a partially exploded isometric view of a spring attached texturing bit according to an example embodiment described herein.

In another embodiment, FIGS. 33 and 34 show a texturing head 1010 having finishing pads 1042 mounted on texturing bits 1012 configured to conform to a curved or contoured work surface. The texturing bits 1012 comprise a cross-shaped pivoting body 1084. In some aspects, the cross-shaped pivoting body 1084 can be made in one piece with cylindrical portions 1102 formed on a first axis and with additional cylindrical portions 1104 formed on a second axis orthogonal to the first axis 1102. In some aspects, the cross-shaped pivoting body 1084 can be made in more than one piece. In this embodiment, a texturing bit 1012 further comprises a pair of pivot supports 1086 attached to the base plate 1014 and a pair of pivot supports 1088 attached to the bit plate 1034. The pivot supports 1086 can be a have a flat portion 1090 to mount to the base plate 1014 with a rounded portion 1092 on the opposite end with an aperture 1093 on the opposite end to allow pivoting of the bit plate 1034 without obstruction. Like e, pivot supports 1088 are substantially similar in shape, with a flat portion 1094 to mount to the bit plate 1034 with a rounded portion 1096 with an aperture 1097 on the opposing end to allow movement. The cross-shaped pivoting body 1084 can be positioned with cylindrical portions 1098 inserted into apertures 1093, 1097 respectively.

For example, FIG. 33 illustrates the assembly of texturing bit 1012, where cylindrical portions 1102*a*, 1102*b* of a cross-shaped pivoting body 1084 are inserted in apertures 1093*a*, 1093*b* of pivot supports 1086*a*, 1086*b*, respectively, attached to base plate 1014, which allow the cross-shaped pivoting body to pivot along a first axis. Likewise, cylindrical portions 1104*a*, 1104*b* of a cross-shaped pivoting body 1084 are inserted in apertures 1097*a*, 1097*b* of pivot supports 1088*a*, 1088*b*, respectively, which allow the cross-shaped pivoting body to pivot about a second axis. With pivot supports 1088*a*, 1088*b* attached to bit plate 1034 (shown in FIG. 34), the finishing pad 1042 is able to rotate about two orthogonal axes.

Figure 35:
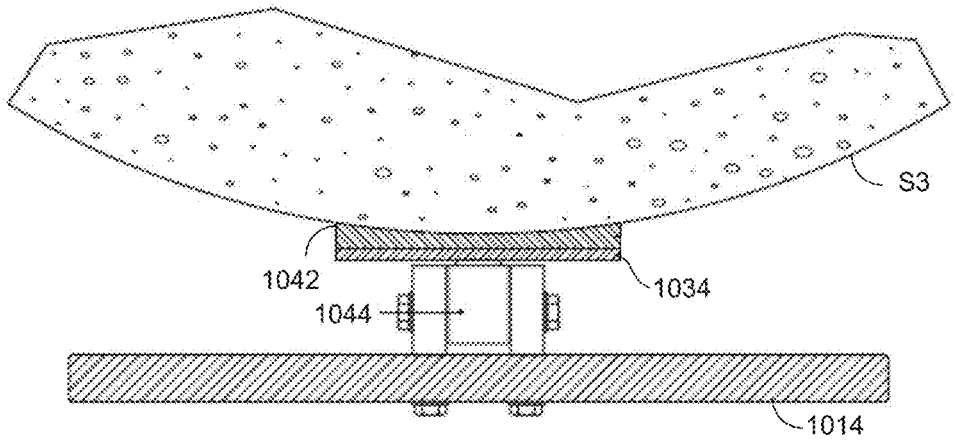
FIG. 35 is a cross-sectional view along the axis of a pivot shaft of an embodiment of a texturing head engaged with a column according to various embodiments.
Figure 36:
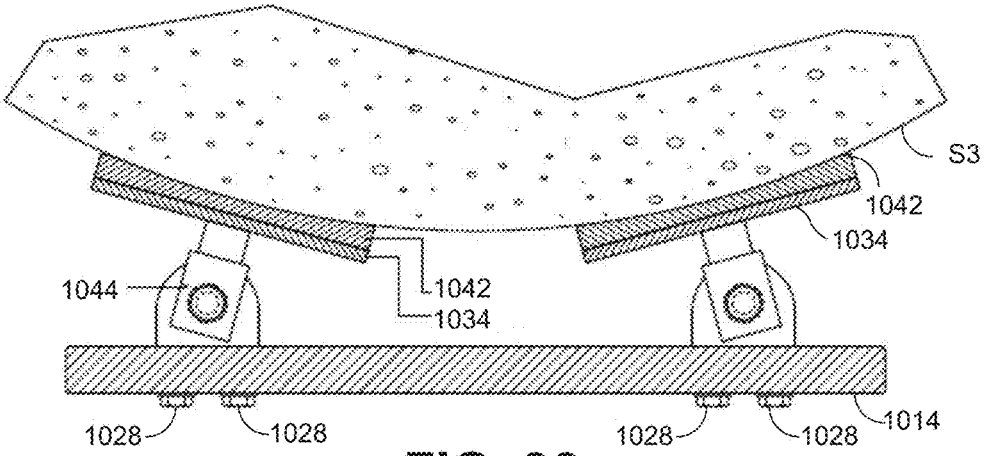
FIG. 36 is a cross-sectional view at the side of two texturing bits a texturing head engaged with a column, according to various embodiments.

Next, FIG. 35 illustrates an example of a texturing head 1010 with a finishing pad 1042 positioned against a column C3. According to various embodiments, a texturing bit 1012 can comprise a spring 1044 (not shown) which can be compressed when in contact with a work surface S. In some aspects, the finishing pad 1042 can be made of a compressible material, such that the pad 1042 remains in contact and forms to the convex surface of a column S3. In another aspect, FIG. 36 illustrates and example of a texturing head 1010 in an alternate view with finishing pads 1042 positioned against a column C3. In some aspects, the finishing pad 1042 can be made of a compressible material, such that the pad 1042 remains in contact and forms to the convex surface of a column S3, while the spring 1044 is expanded to allow tilted positioning of the finishing pad 1042 along the column S3.

As described above any of the texturing heads 1010 including any one or more of the aforementioned pivoting members 1016 can be secured to a motor, such as motor 214, as well as the aforementioned system of FIGS. 1-16, configured to move the texturing head 1010 across a work surface to texture the work surface, for example polish the work surface.

As will be apparent to those of skill in the art upon reading this disclosure, each of the individual embodiments described and illustrated herein has discrete components and features which may be readily separated from or combined with the features of any of the other several embodiments without departing from the scope or spirit of the present disclosure. Any recited method can be carried out in the order of events recited or in any other order that is logically possible.

While the present disclosure has been described in connection with certain embodiments, it is to be understood that the subject matter encompassed by way of the present disclosure is not to be limited to those specific embodiments. On the contrary, it is intended for the subject matter of the disclosure to include all alternatives, modifications, and equivalents as can be understood by one of ordinary skill in the art.

Therefore, the following is claimed:

1. A texturing head for a surfacing apparatus comprising:
at least one texturing bit, the at least one texturing bit including a finishing pad configured to be movable across a work surface;
a base plate, the base plate having a generally planar surface and being attached to a shaft, the shaft being perpendicular to the planar surface of the base plate, the base plate configured for rotation about the shaft; and
a pivot device coupling the at least one texturing bit to the base plate, the pivot device configured to allow the texturing bit to pivot at least about an axis generally transverse to the surface of the base plate to conform to the contour of the work surface.

2. The texturing head for a surfacing apparatus of claim 1, including a motor configured to move the at least one finishing pad across the work surface.

3. A texturing head for a surfacing apparatus comprising:
at least one texturing bit, the at least one texturing bit including a finishing pad configured to be movable across a work surface;
a base plate; and
a pivot device coupling the at least one texturing bit to the base plate, the pivot device configured to allow the texturing bit to conform to the contour of the work surface,
wherein the texturing bit includes
a texturing bit plate; and the pivot device includes one or more pivot members, a pivot block, and a pivot shaft; and
wherein the one or more pivot members are attached to the at least one texturing bit plate and the pivot block is attached to the base plate.

4. The texturing head for a surfacing apparatus of claim 3, wherein the texturing bit further comprises at least one spring positioned between the pivot members and the bit plate.

5. A texturing head for a surfacing apparatus comprising:
at least one texturing bit, the at least one texturing bit including a finishing pad configured to be movable across a work surface;
a base plate; and
a pivot device coupling the at least one texturing bit to the base plate, the pivot device configured to allow the texturing bit to conform to the contour of the work surface,
wherein the texturing bit includes:
a bit plate; a ball post; and a socket; and
wherein the socket is attached to the bit plate and the ball post is mated with the socket.

6. The texturing head for a surfacing apparatus of claim 5, wherein the ball post is attached to the base plate.

7. The texturing head for a surfacing apparatus of claim 5, the texturing bit further comprising a post seat attached to the base plate and a spring disposed between the post seat and the ball post.

8. The texturing head for a surfacing apparatus of claim 1, wherein the texturing bit includes:
a bit plate, a spring, and a spring seat; and
wherein the spring is secured to the bit plate and the spring seat allowing movement of the at least one finishing pad.

9. The texturing head for a surfacing apparatus of claim 8, wherein the spring has an uncompressed length longer than the height of the spring seat allowing a clearance between the bottom of the bit plate and the top of the spring seat.

10. A texturing head for a surfacing apparatus comprising:
at least one texturing bit, the at least one texturing bit including a finishing pad configured to be movable across a work surface;
a base plate; and
a pivot device coupling the at least one texturing bit to the base plate, the pivot device configured to allow the texturing bit to conform to the contour of the work surface,
wherein the texturing bit includes:
a texturing bit plate, and the pivot device includes a cross-shaped pivot member; and
wherein the cross-shaped pivot member is secured along one axis to a base plate and the cross-shaped pivot member secured along an orthogonal axis to the bit plate.

11. The texturing head for a surfacing apparatus of claim 1, including a tensioning device configured to provide a substantially constant pressure of the at least one finishing pad against the work surface, wherein the work surface is a surface of a wall or column.

12. The texturing head for a surfacing apparatus of claim 1, further comprising a lift mechanism configured to raise and lower the texturing head in relation to the work surface.

13. The texturing head for a surfacing apparatus of claim 1, wherein a motor is pivotally attached to the texturing head.

14. A method comprising:
a) providing a texturing device, the texturing device comprising:
a texturing head comprising:
at least one texturing bit, the at least one texturing bit including a finishing pad configured to be movable across a work surface;
a base plate, the base plate having a generally planar surface and being attached to a shaft, the shaft being perpendicular to the planar surface of the base plate, the base plate configured for rotation about the shaft; and a pivot device coupling the at least one texturing bit to the base plate, the pivot device configured to allow the texturing bit to pivot at least about an axis generally transverse to the surface of the base plate to conform to the contour of the work surface; and a motor configured to move the at least one finishing pad across the work surface;

b) positioning the texturing head in relation to the contoured work surface and placing the finishing pad in contract with the work surface;

c) adjusting a pressure of the texturing head to apply a desired pressure of the finishing pad against the work surface;

d) using the motor to move the finishing pad across the work surface; and e) moving the texturing head including the finishing pad in a path across the work surface while maintaining the finishing pad in contact with the work surface and while using the motor to move the finishing pad across the work surface.

15. The method according to claim 14, wherein the texturing device includes, a tensioning device configured to provide a substantially constant pressure of the at least one finishing pad against the work surface, wherein the work surface is a surface of a wall.

16. The method according to claim 14, wherein the work surface is a concave surface.

17. The method according to claim 14, wherein the work surface is a convex surface.

18. The method according to claim 14, wherein the work surface is a column.

* * * * *